US005966102A

United States Patent [19]

Runyon

[11] Patent Number: 5,966,102

[45] **Date of Patent: *Oct. 12, 1999**

[54] DUAL POLARIZED ARRAY ANTENNA WITH CENTRAL POLARIZATION CONTROL

[75] Inventor: Donald L. Runyon, Duluth, Ga.

[73] Assignee: EMS Technologies, Inc., Norcross, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/572,529

[22] Filed: Dec. 14, 1995

[51] Int. Cl.[6] ..... H01Q 9/16

[52] U.S. Cl. ..... 343/820; 343/797; 343/814

[58] Field of Search ..... 343/795, 797, 343/820, 821, 853, 814, 793, 810; H01Q 21/26, 9/16, 21/24

[56] References Cited

U.S. PATENT DOCUMENTS

| | | | |
|---|---|---|---|
| 3,541,559 | 11/1970 | Evans | 343/795 |
| 3,836,976 | 9/1974 | Monser et al. | 343/797 X |
| 3,854,140 | 12/1974 | Ranghelli et al. | 343/814 |
| 3,887,925 | 6/1975 | Ranghelli et al. | 343/795 |
| 4,051,474 | 9/1977 | Mack et al. | 343/756 |
| 4,315,264 | 2/1982 | DuHamel | 343/797 |
| 4,342,997 | 8/1982 | Evans | 343/16 R |
| 4,434,425 | 2/1984 | Barbano | 343/797 |
| 4,518,969 | 5/1985 | Bogner | 343/819 |
| 4,672,386 | 6/1987 | Wood | 343/770 |
| 4,686,536 | 8/1987 | Allcock | 343/797 X |
| 4,816,835 | 3/1989 | Abiko et al. | 343/700 MS |
| 4,983,988 | 1/1991 | Franke | 343/853 |
| 5,111,214 | 5/1992 | Kumpfbeck et al. | 343/841 |
| 5,206,655 | 4/1993 | Caille et al. | 343/700 MS |
| 5,264,862 | 11/1993 | Kumpfbeck | 343/820 X |
| 5,268,701 | 12/1993 | Smith | 343/767 |
| 5,434,575 | 7/1995 | Jelinek et al. | 342/365 |
| 5,461,394 | 10/1995 | Weber | 343/837 |
| 5,469,181 | 11/1995 | Yarsunas | 343/815 |
| 5,568,162 | 10/1996 | Samsel et al. | 343/788 X |
| 5,748,156 | 5/1998 | Weber | 343/792 |

FOREIGN PATENT DOCUMENTS 0 342 175 11/1989 European Pat. Off. .

OTHER PUBLICATIONS

"Reflector Antenna Analysis and Design", by P.J. Wood, published by the Institution of Electrical Engineers, London and New York, copyright 1980, pp. 24–27 and 123–151.

"An Improved Element for Use in Array Antennas", by A. Clavin, D.A. Huebner, and F.J. Kilburg, IEEE Transactions on Antennas and Propagation, vol. AP–22, No. 4, Jul. 1974, pp. 521–526.

"The Definition of Cross Polarization", by A.C. Ludwig, IEEE Transactions on Antennas and Propagation, vol. AP–21, Jan. 1973, pp. 116–119.

"The Latest in Cellular and PCS" by H. Bainbridge, Wireless Product News, Jan. 1996, pp. 16–18.

*Primary Examiner*—Don Wong
*Assistant Examiner*—Tho Phan
*Attorney, Agent, or Firm*—Jones & Askew, LLP

[57] ABSTRACT

A planar array antenna having radiating elements characterized by dual simultaneous polarization states and having substantially rotationally symmetric radiation patterns. A distribution network, which is connected to each dual polarized radiator, communicates the electromagnetic signals from and to each radiating element. A ground plane is positioned generally parallel to and spaced apart from the radiating elements by a predetermined distance. The conductive surface of the ground plane operates to image the radiating elements over a wide coverage area, thereby enabling a radiation pattern within an azimuth plane of the antenna to be independent of any quantity of radiating elements. A central polarization control network (PCN), which is connected to the distribution network, can control the polarization states of the received signals distributed via the distribution network by the radiating elements.

43 Claims, 18 Drawing Sheets

ANTENNA BLOCK DIAGRAM

ANTENNA BLOCK DIAGRAM

ANTENNA BLOCK DIAGRAM

ANTENNA BLOCK DIAGRAM

ANTENNA BLOCK DIAGRAM

POLARIZATION FORMING NETWORKS (PCNs)

DUAL POLARIZED ARRAY ANTENNA WITH CENTRAL POLARIZATION CONTROL

TECHNICAL FIELD

The present invention is generally directed to an antenna for communicating electromagnetic signals, and relates more particularly to a planar array antenna having wave radiators exhibiting dual polarization states and aligned over a ground plane of sufficient radio-electrical size to achieve substantially rotationally symmetric radiation patterns.

BACKGROUND OF THE INVENTION

Diversity techniques at the receiving end of a wireless communications link can improve signal performance without additional interference. Space diversity typically uses two or more receive antennas spatially separated in the plane horizontal to local terrain. The use of physical separation to improve communications system performance is generally limited by the degree of cross-correlation between signals received by the two antennas and the antenna height above the local terrain. The maximum diversity improvement occurs when the cross-correlation coefficient is zero.

For example, in a space diversity system employing two receive antennas, the physical separation between the receive antennas typically is greater than or equal to eight (8) times the nominal wavelength of the operating frequency for an antenna height of 100 feet (30 meters). Moreover, the physical separation between antennas typically is greater than or equal to fourteen (14) times for an antenna height of 150 feet (50 meters). The two-branch space diversity system cross-correlation coefficient is set to 0.7 for the separations identified above. At an operating frequency of 850 MHz, a separation factor of 8 wavelengths between receive antennas creates a ±2 dB power difference, which provides a sufficient improvement of signal reception performance for the application of the diversity technique. For a communications system operating at 850 MHz, the physical separation of the receive antennas is approximately nine feet (3 meters).

Site installation issues become increasingly impractical for lower frequency applications for which the wavelength is greater. For instance, the antenna separation required at 450 MHz is nearly 18 feet for equivalent space diversity performance assuming the same height criteria is applicable. Although the site installation issues would be relieved for higher frequencies because of the reduction in the baseline distance required for diversity performance, there is a need to reduce the physical presence of base station antennas to improve the overall appearance of the antenna within its operating environment and to improve the economics of the site installation.

Present antennas for wireless communications systems typically use vertical linear polarization as the reference or basis polarization characteristic of both transmit and receive base station antennas. The polarization of an antenna in a given direction is the polarization of the wave radiated by the antenna. For a field vector at a single frequency at a fixed point in space, the polarization state is that property which describes the shape and orientation of the locus of the extremity of the field vector and the sense in which the locus is traversed. Cross polarization is the polarization orthogonal to the reference polarization.

Space diversity antennas typically have the same vertical characteristic polarization state for the receive antennas. Space diversity, when applied with single polarization antennas, is incapable of recovering signals which have polarization characteristics different from the receive antennas. Specifically, signal power that is cross polarized to the antenna polarization does not effectively couple into the antenna. Hence, space diversity systems using single polarized antennas have limited effectiveness for the reception of cross-polarized signals. Space diversity performance is further limited by angle effects, which occur when the apparent baseline distance between the physically separated antennas is reduced for signals having an angle of arrival which is not normal to the baseline of the spatially separated array.

Polarization diversity provides an alternative to the use of space diversity for base stations of wireless communications systems, particularly those supporting Personal Communications Services (PCS) or cellular mobile radiotelephone (CMR) applications. The potential effectiveness of polarization diversity relies on the premise that the transmit polarization of the typically linearly polarized mobile or portable communications unit will not always be aligned with a vertical linear polarization for the antenna at the base station site or will necessarily be a linearly polarized state (e.g., elliptical polarization). For example, depolarization, which is the conversion of power from a reference polarization into the cross polarization, can occur along the propagation path(s) between the mobile user and base station. Multipath propagation generally is accompanied by some degree of signal depolarization.

Polarization diversity may be accomplished for two-branches by using an antenna with dual simultaneous polarizations. Dual polarization allows base station antenna implementations to be reduced from two physically separated antennas to a single antenna having two characteristic polarization states. Dual polarized antennas have typically been used for communications between a satellite and an earth station. For the satellite communication application, the typical satellite antenna is a reflector-type antenna having a relatively narrow field of view, typically ranging between 15 to 20 degrees to provide a beam for Earth coverage. A dual polarized antenna for a satellite application is commonly implemented as a multibeam antenna comprising separate feed element arrays and gridded reflecting optics having displaced focal points for orthogonal linear polarization states or separate reflecting optics for orthogonal circular polarization states. An earth station antenna typically comprises a high gain, dual polarized antenna with a relatively narrow "pencil" beam having a half power beamwidth (HPBW) of a few degrees or less.

The present invention provides the advantages offered by polarization diversity by providing antenna having an array of dual polarized radiating elements arranged within a planar array and exhibiting a substantially rotationally symmetric radiation pattern over a wide field of view. In contrast to prior dual polarized antennas, present invention maintains the substantially rotationally symmetric radiation pattern for HPBW within the range of 45 to 120 degrees. A high degree of orthogonality is achieved between the pair of antenna polarization states regardless of the look angle over the antenna field of view. The antenna dual polarizations can be determined by centrally-located polarization control network, which is connected to the array of dual polarized radiators and can accept the polarization states of received signals and output signals having different predetermined polarization states. The antenna of the present invention can achieve a compact structure resulting in low radio-electric space occupancy, and is easy and relatively inexpensive to reproduce.

SUMMARY OF THE INVENTION

The present invention is generally directed to a dual polarized planar array antenna having radiating elements characterized by dual simultaneous polarization states and having substantially rotationally symmetric radiation patterns. A substantially rotationally symmetric radiation pattern is a co-polarized pattern response having "pseudo-circular symmetry" properties and principal (E- and H-) plane patterns that are different by no more than approximately 3.1 dB at any value of theta over the field of view for the antenna. Alternatively, a substantially rotationally symmetric radiation pattern can be viewed as a co-polarized pattern response having "pseudo-circular symmetry" properties and a cross-polarization ratio less than approximately −15 dB within the field of view for the antenna. A beam forming network (BFN), typically implemented as a distribution network, is connected to each dual polarized radiator and communicates the electromagnetic signals from and to each radiating element.

The dual polarized planar array antenna can include a ground plane and a central polarization control network. The ground plane is positioned generally parallel to and spaced apart from the radiating elements by a predetermined distance. The ground plane typically has sufficient radio-electric extent in a plane transverse to the antenna to image the radiating elements over a wide coverage area, thereby enabling a radiation pattern within an azimuth plane of the antenna to be independent of any quantity of the radiators. The PCN, which is connected to the distribution network, can control the polarization states of the received signals distributed via the distribution network by the radiating elements.

More particularly described, the present invention provides an antenna having a planar array of dual polarized radiating elements characterized by dual simultaneous polarization states and having substantially rotationally symmetric element radiation patterns. The array radiation patterns comprise a first radiation pattern in an elevation plane of the antenna and a second radiation pattern in an azimuth plane of the antenna. The first radiation pattern is defined by the geometry of the antenna system and the second radiation pattern is defined by the characteristics of the dual polarized radiating elements and the ground plane.

Each dual polarized radiating element can be implemented as a crossed dipole pair having a first dipole element and a second dipole element positioned orthogonal to each other. Each crossed dipole pair can be positioned along the conductive surface of ground plane and within a vertical plane of the antenna to form a linear array. The cross dipole pairs, in combination with the ground plane, can exhibit rotationally symmetric radiation patterns in response to a linearly polarized electromagnetic signal having any orientation.

For example, the polarization states of a crossed dipole pair can be a slant left polarization state and a slant right polarization state. These polarization states are orthogonal, thereby minimizing the cross-polarization response of any electromagnetic signal received by the antenna. The polarization states are maintained for a wide coverage area (half power beamwidth) of at least 45 degrees in an azimuth plane of the antenna.

The BFN comprises a distribution network having a first power divider connected to each first radiating element having a first polarization state and another distribution network having a second power divider connected to each second radiating element having a second polarization state. The pair of distribution networks are connected between the radiating elements and the PCN.

The PCN can include a pair of duplexers, specifically a first duplexer and a second duplexer, and a power combiner. The first duplexer is connected to the first power divider and has a first receive port and a first transmit port. The second duplexer is connected to the second power divider and has a second receive port and a second transmit port. Responsive to electromagnetic signals received by the radiating elements, the first and second receive ports output receive signals. The first and second transmit ports, which are connected to the power combiner, accept a transmit signal.

The PCN also can include a 0 degree/180 degree "rat race"-type hybrid coupler connected to the first and second receive ports of the duplexers. For example, if the antenna includes an array of crossed dipole pairs having slant left and slant right polarization states, the hybrid coupler can accept the receive signals from the duplexer receive ports and can output a receive signal having a vertical linear polarization state. The hybrid coupler also can accept these receive signals and, in turn, output a receive signal having a horizontal linear polarization state.

Alternatively, the PCN can comprise a 0 degree/90 degree quadrature-type hybrid coupler connected to the first and second receive ports of the duplexers. For an antenna including an array of crossed dipole pairs having slant left and slant right polarization states, the hybrid coupler can accept the receive signals from the duplexer receive ports and can output a receive signal having a left-hand circular polarization state. The hybrid coupler also can accept the receive signals and, in turn, output a receive signal having a right-hand circular polarization state.

As suggested above, flexibility in the choice of the polarization pair is determined by a relatively few component changes in the PCN. It will be appreciated that the PCN of the present invention includes significantly fewer components than the number of array elements in cases for which the number of array elements is greater than two. Hence, the antenna configuration and detailed implementation can be largely the same for a given design with the flexibility to select the polarization by few component changes. This feature is important for high volume manufacturing because the application of polarization diversity may demand different polarization pairs based on the communication system application, the type of diversity combiner, and the type of environment (e.g., rural, suburban, urban, in-building, etc.). The PCN also facilitates the ability to use the antenna in a full duplex mode of operation for both transmit and receive modes in the event that the transmit polarization state may be different than the dual receive polarization states.

The ground plane can be implemented as a solid conductive surface having major and minor dimensions corresponding to the array dimensions. Alternatively, the ground plane can comprise a solid conductive surface and an non-solid conductive surface. The solid conductive surface has a transverse extent dimension sufficient to achieve the desired polarization state for a vertical polarization component. In contrast, the non-solid conductive surface comprises a pair of parallel, spaced-apart conductive elements aligned within the horizontal plane of the antenna and symmetrically positioned along each transverse extent of the solid conductive surface. The transverse extent dimension of the solid conductive surface is approximately one wavelength for a selected center frequency, and each of the grid elements is spaced-apart (center-to-center) by approximately ⅓ to ½ of a wavelength for the selected center frequency.

The ground plane can also be implemented as a substantially planar sheet comprising a conductive material. Alternatively, the ground plane can be implemented as a substantially non-level, continuously curved sheet of conductive material or as a piece-wise curved implementation comprising conductive material.

Because the electric centers of the two polarization states are preferably co-located for the antenna of the present invention, the antenna generally does not represent an application of spatial separation. However, this co-location of electric centers takes up minimum space in the transverse direction and complies with a need of the present invention to match the time delay of signals coupled to each polarization state. The polarization diversity of the antenna provided by the present invention offers the distinct advantages of reduced size and complexity of an antenna installation.

In view of the foregoing, it is an object of the present invention to provide an antenna to provides an antenna having radiating elements characterized by dual simultaneous polarization states and having substantially rotationally symmetric radiation patterns.

It is a further object of the present invention to provide an antenna employing crossed pairs of dipole-type radiating elements arranged in a planar array configuration, wherein the orientations of the dipole radiating elements are ±45° with respect to the axis parallel to the antenna.

It is a further object of the present invention to provide a combination of an array of dual-polarized dipole-type radiating elements and a radio-electric ground plane to generate a rotationally symmetric, or nearly so, radiation pattern characteristic.

The present invention will be more fully understood from the detailed description below, when read in connection with the accompanying drawings, and in view of the appended claims.

DETAILED DESCRIPTION

Figure 1:
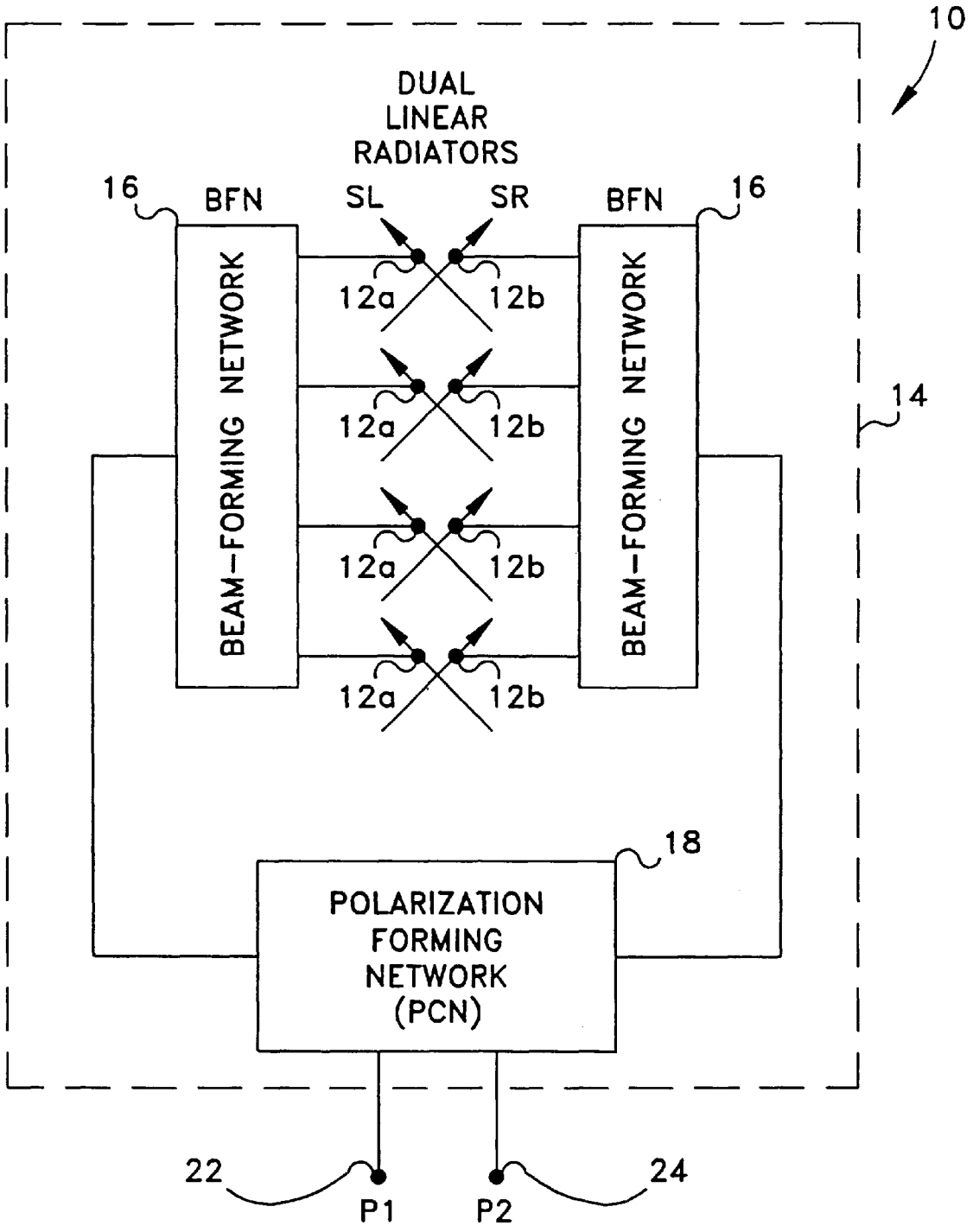
FIG. 1 is a block diagram illustrating the primary components of the preferred embodiment of the present invention.

The antenna of the present innovation is useful for wireless communications applications, such as Personal Communications Services (PCS) and cellular mobile radiotelephone (CMR) service. The antenna uses polarization diversity to mitigate the deleterious effects of fading and cancellation resulting from a complex propagation environment. The antenna includes an array of dual polarized radiating elements and a beam-forming network (BFN) consisting of a power divider network for array excitation. In combination with the radiating elements, a conductive surface operative as a radio-electric ground plane supports the generation of substantially rotationally symmetric patterns over a wide field of view for the antenna. A polarization control network (PCN), which is centrally connected to the array via the distribution network, provides a mechanism for control of the polarization states.

Those skilled in the art will appreciate that poor antenna polarization performance characteristics can limit the available communications system power transfer. Prior to discussing the embodiments of the antenna provided by the present invention, it will be useful to review the salient features of an antenna exhibiting dual polarization characteristics.

In general, the far-field of an antenna can be represented by a Fourier expansion in a standard spherical coordinate system as:

$$E_{\Theta}=\Sigma_m[A_m(\Theta)\sin(\Phi)+B_m(\Theta)\cos(\Phi)]$$

$$E_{\Phi}=\Sigma_m[C_m(\Theta)\sin(\Phi)+D_m(\Theta)\cos(\Phi)]$$

where $E_{\Theta}$ and $E_{\Phi}$ are the component of the electric field in the $\Theta$ and $\Phi$ directions of a standard spherical coordinate system. Unit vectors $u_x$, $u_y$, and $u_z$ are aligned with the x, y, and z axis of the corresponding Cartesian coordinate system with the same origin.

In general, the coefficients are complex numbers to encompass all varieties of polarizations and angular phase distributions. The group phase and spreading factor common to both field components is omitted for the purposes here. If the beam possesses 'pseudo-circular symmetry' then the field may be accurately represented with a single expansion term (m=1). For a $u_y$ directed electric field (E-field) on boresight, the 'pseudo-circular symmetry' field representation is:

$$E_1(\Theta,\Phi)=f_1(\Theta)\sin(\Phi)u_\Theta+f_2(\Theta)\cos(\Phi)u_\Phi$$

where $f_1(\Theta)$ and $f_2(\Theta)$ are the principal plane normalized field pattern cuts and the variation is described by first order cosine and sine harmonics. Unit vectors $u_\Theta$ and $u_\Phi$ are in the direction of $\Theta$ and $\Phi$, respectively. The above form assumes a standard spherical coordinate system, with the plane of the electric field (E-plane) defined by $\Phi=90°$ and the plane of the magnetic field (H-plane) defined by $\Phi=0°$. The representation for a $u_x$ directed E-field on boresight is:

$$E_2=f_3(\Theta)\cos(\Phi)u_\Theta-f_4(\Theta)\sin(\Phi)u_\Phi$$

The condition for orthogonality between the two polarization components is:

$$E_1(\Theta,\Phi)\cdot E_2^*(\Theta,\Phi)=0$$

where · denotes the inner product and * denotes the complex conjugate. From which it follows:

$$[f_1(\Theta)f_3^*(\Theta)-f_2(\Theta)f_4^*(\Theta)]\tfrac{1}{2}\sin(2\Phi)=0$$

Hence, orthogonality can only be achieved irrespective of the look angle if:

$$f_1(\Theta)f_3^*(\Theta)-f_2(\Theta)f_4^*(\Theta)=0$$

At $\Theta=0°$, the normalized field components are unity and the orthogonality condition is satisfied. Away from boresight, there are a number of individual conditions for principal plane pattern characteristics of the two basis polarizations which will satisfy the orthogonality condition. In general, the product of the E-plane patterns must equal the product of the H-plane patterns for the two basis polarizations at each value of $\Theta$. If the problem is further simplified by assuming the patterns have equal phase distributions, the only remaining condition to satisfy orthogonality is the patterns must be circularly symmetric. The degree of orthogonality will degrade from the ideal as pattern symmetry degrades.

The substitution $\Phi-\Phi_o\rightarrow\Phi$ in the field equations facilitates polarization rotation from alignment with the x-y axis of a Cartesian coordinate system at the antenna boresight to the axis coinciding with $\Phi=\pm\Phi_o$ Dual slant linear (slant left, slant right) polarizations are formed with $\Phi_o=45°$. Choosing the definition of slant left (SL) as the rotated $u_y$ directed E-field on boresight and slant right (SR) as the rotated $u_x$ directed E-field on boresight as viewed looking in the +z direction, the field representations are:

$$\underline{E}_{SL}(\Theta,\Phi)=\frac{1}{\sqrt{2}}f_1(\Theta)[\sin(\Phi)-\cos(\Phi)]\underline{u}_\Theta+\frac{1}{\sqrt{2}}f_2(\Theta)[\cos(\Phi)+\sin(\Phi)]\underline{u}_\Phi$$

$$\underline{E}_{SR}(\Theta,\Phi)=\frac{1}{\sqrt{2}}f_3(\Theta)[\cos(\Phi)+\sin(\Phi)]\underline{u}_\Theta-\frac{1}{\sqrt{2}}f_4(\Theta)[\sin(\Phi)-\cos(\Phi)]\underline{u}_\Phi$$

Definition 3 of A. C. Ludwig, "The Definition of Cross Polarization," *IEEE Trans. Antennas Propagat.*, vol. AP-21, pp. 116–119, January 1973 is used herein for the definition of "cross polarization". Definition 3 describes the field contours of a theoretical elemental radiator known as a Huygens source. The Huygens source is a combination of an electric dipole and a magnetic dipole of equal intensity and crossly oriented. The Huygens source is unique among all admixtures of electric and magnetic dipoles in that when it is rotated 90° about its boresight axis ($u_z$) the fields produced are (at all look angles) exactly orthogonal to those produced by the un-rotated source. Hence, if two Huygens sources (oriented exactly 90° in $\Phi$ with respect to each other in a standard spherical coordinate system) are chosen as two radiating elements for a dual polarized antenna, they will provide a pair of basis polarizations which are always orthogonal (irrespective of look angle). Consequently, the polarization produced when the two orthogonal radiators are excited with a given amplitude and phase weighting may vary only in tilt angle as a function of and relative to the synthesized boresight polarization.

The characteristics of a Huygens source is one of the characteristics desired of an orthogonal radiator for the polarization diversity application. It would, of course, be desirable that the tilt angle also remain invariant; however, it is difficult to define what invariance of tilt angle is due to difficulties of establishing definitions of polarization. Polarization orthogonality is the primary concern in providing optimum polarization coverage performance since the communications link depends only on a single polarization to any user. Several desirable pattern features are attendant with the conditions for optimum antenna polarization performance.

For the purpose of describing the key features of the preferred embodiment of the present inventions, an array of radiating elements is taken along the y-axis of a standard Cartesian coordinate system and lies in the x-y plane. The elevation plane of the array is defined as the plane passing through the beam peak and along the y-axis. The azimuth plane is transverse to elevation and the principal plane pattern cut is through the beam peak.

If the mutual element coupling is sufficiently low in the array, then the pattern requirements for optimum polarization coverage can be applied to a radiating element alone. The field due to an array of Huygens sources has the same polarization as that of a single Huygens source. However, the radiation pattern is different. The array factor has no polarization properties since it is the pattern of an array of isotropic radiators. This is of importance in the present invention because the radiation pattern intensity in the elevation plane can be primarily controlled by the array geometry, whereas the polarization of the radiated wave is completely established by the choice of array element as are the pattern features in the azimuth plane.

For a linear array, the preferred orientation of element polarizations is slant (±45°) relative to the array (y-axis) in order to achieve the best balance in the element pattern symmetry in the presence of mutual coupling between array elements. The boundary conditions of a finite radio-electric ground plane aligned along the major and minor axis of the array are the same for the two crossly oriented element polarizations when the element is centered on the ground plane.

The unit vector definitions of the reference (co-polarized) and cross-polarized fields for a $u_y$ directed E-field on boresight are using definition 3 are:

$$e_{ref}(\Theta,\Phi)=\sin(\Phi)u_\Theta+\cos(\Phi)u_\Phi$$

$$e_{cross}(\Theta,\Phi)=\cos(\Phi)u_\Theta-\sin(\Phi)u_\Phi$$

and for a $u_x$ directed E-field on boresight are:

$$e_{ref}(\Theta,\Phi)=\cos(\Phi)u_\Theta-\sin(\Phi)u_\Phi$$

$$e_{cross}(\Theta,\Phi)=\sin(\Phi)u_{\Theta}+\cos(\Phi)u_{\Phi}$$

For SL and SR polarizations, the reference and cross-polarized unit vector definitions may be obtained in a like manner as before by substitution for Φ effecting a rotation of 45°.

Several features of the antenna provided by the present invention are illustrated by considering the pattern polarization characteristics in the Φ=0° azimuth plane of the array with dual slant element characteristic polarizations. First, the electric field distribution may be written in terms of the reference and cross-polarized components as:

$$E_{SL}(\Theta,\Phi=0)=\tfrac{1}{2}[f_1(\Theta)+f_2(\Theta)]u_{ref}+\tfrac{1}{2}[f_2(\Theta)-f_1(\Theta)]u_{cross}$$

$$E_{SR}(\Theta,\Phi=0)=\tfrac{1}{2}[f_3(\Theta)+f_4(\Theta)]u_{ref}+\tfrac{1}{2}[f_4(\Theta)-f_3(\Theta)]u_{cross}$$

The cross-polarization pattern constitutes one-half the difference of the principal (E- and H-plane) patterns of the radiating element. Zero cross-polarization implies complete rotational symmetry of the co-polarized pattern. Zero cross-polarization corresponds to orthogonality for the dual polarized source.

Further, the inner product of the slant polarized field with the reference polarization for a $u_y$ directed E-field on boresight results in the pattern which is a multiplying factor of one-half the normalized co-polarized H-plane pattern of the radiating element. The inner product of the slant polarized field with the reference polarization for a $u_x$ directed E-field on boresight results in the pattern which is multiplying factor of one-half the normalized co-polarized E-plane pattern of the radiating element. The coverage in the azimuth plane will be the same, separate from a constant factor of one-half only if the radiator element pattern has complete rotational symmetry. The feature of the same pattern distribution, apart from the constant factor, is considered an important feature of an antenna for use in a communication system using polarization diversity. Otherwise, the amplitude difference in the polarization coupling of a linearly polarized signal to the linearly polarized antenna is greater than the ideal polarization mismatch factor for misalignments up to 45° resulting in sub-optimum polarization diversity performance. This reduction in polarization coupling is a consequence of the degree of orthogonality where the coupling is reduced relative to the ideal case when polarization orthogonality exists.

An additional feature of a rotationally symmetric radiation pattern is the azimuth pattern characteristic of the array will remain invariant when the two beams corresponding to dual polarized element characteristic polarizations are weighted together to form a polarization pair differing from the natural element polarizations. This capability is considered an interesting field of application of the proposed invention. Although the examples used to illustrate the key polarization features are for linear polarizations, the same holds true for other orthogonal polarization pairs. The use of dual circular polarization (right hand, left hand senses) is believed to also be applicable to wireless communication systems using polarization diversity.

Turning now to the drawings, in which like reference numbers refer to like elements, FIG. 1 is a block diagram illustrating the primary components of the preferred embodiment of the present invention. Referring to FIG. 1, an antenna 10 is shown for communicating electromagnetic signals with the high frequency spectrums associated with conventional wireless communications system. The antenna 10 can be implemented as a planar array of radiator elements 12, known as wave generators or radiators, wherein the array is aligned along a vertical plane of the antenna as viewed normal to the antenna site. For the preferred linear array implementation, the array factor predominately forms the elevation coverage and the azimuth coverage is predominately influenced by the element pattern characteristics when no downtilt (mechanical or electrical) is applied. In general, this linear array may be categorized as a fan-beam antenna producing a major lobe whose transverse cross section has a large ratio of major to minor dimensions.

The antenna 10 which can transmit and receive electromagnetic signals, includes radiating elements 12, a ground plane 14, a beam-forming network (BFN) 16, and a polarization control network (PCN) 18. The radiating elements 12, which comprise elements 12*a* and 12*b* exhibiting dual polarization states, are wave generators preferably aligned in a linear array and positioned at a predetermined distance above a conductive surface of the ground plane 14. The radiating element 12 and the ground plane 14 operate in tandem to provide the desired pattern characteristics for the antenna 10. The antenna 10 exhibits a substantially rotationally symmetric radiation pattern which, for the purposes of this specification, is defined as a co-polarized pattern response having "pseudo-circular symmetry" properties and principal (E- and H-) plane patterns that are different by no more than approximately 3.1 dB at any value of theta over the field of view for the antenna. Alternatively, a substantially rotationally symmetric radiation pattern can be viewed as a co-polarized pattern response having "pseudo-circular symmetry" properties and a cross-polarization ratio less than approximately −15 dB within the field of view for the antenna. For the preferred implementation of the antenna 10, a linear array of dual polarized radiating elements exhibits a rotationally symmetric radiation pattern for a wide field of view, typically for a half power beamwidth (HPBW) selected from the range of 45 to 120 degrees.

The BFN 16, which operates as a distribution network, is connected to the radiating elements 12*a* and 12*b* for transporting receive signals from the radiating elements and transmit signals to the radiating elements. The PCN 18, which is connected to the BFN 16, can control the polarization state of receive signals distributed by the BFN 16. Because the radiating elements 12 exhibit dual polarization states, the PCN 18 can accept receive signals having either of two polarization states, and can output electromagnetic signals having a polarization state P1 at a first output port 22 and electromagnetic signals having a polarization state P2 at a second output port 24.

Because the antenna 10 is generally intended for operation with PCS and CMR applications, those skilled in the art will appreciate that the radiating elements 12 are preferably characterized by generally high efficiencies, broad radiation patterns, high polarization purity, and sufficient operating bandwidths. In addition, it is desirable that the radiating elements 12 be lightweight and low in cost, interface directly with the BFN 16, and be integratable with the antenna packaging. Dipole antennas satisfy all of these electrical performance requirements, and a printed implementation fulfills the physical criteria. As will be described in more detail below with respect to FIG. 6, the preferred implementation of each radiator 12*a* and 12*b* is a dipole-type antenna exhibiting the polarization states of slant left (SL) and slant right (SR).

Figure 2:
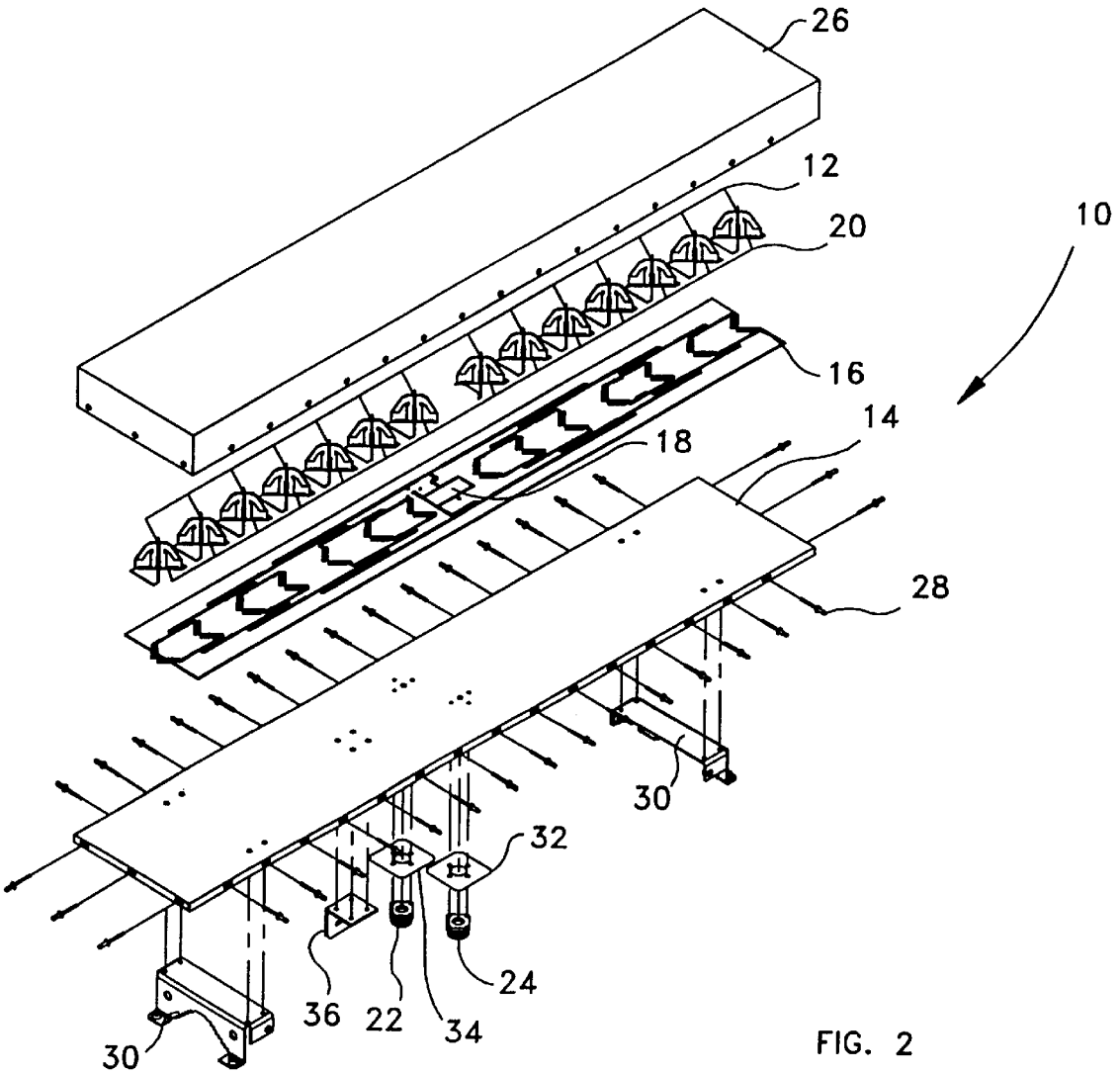
FIG. 2 is an illustration showing an exploded representation of the construction of the preferred embodiment of the present invention.
Figure 3:
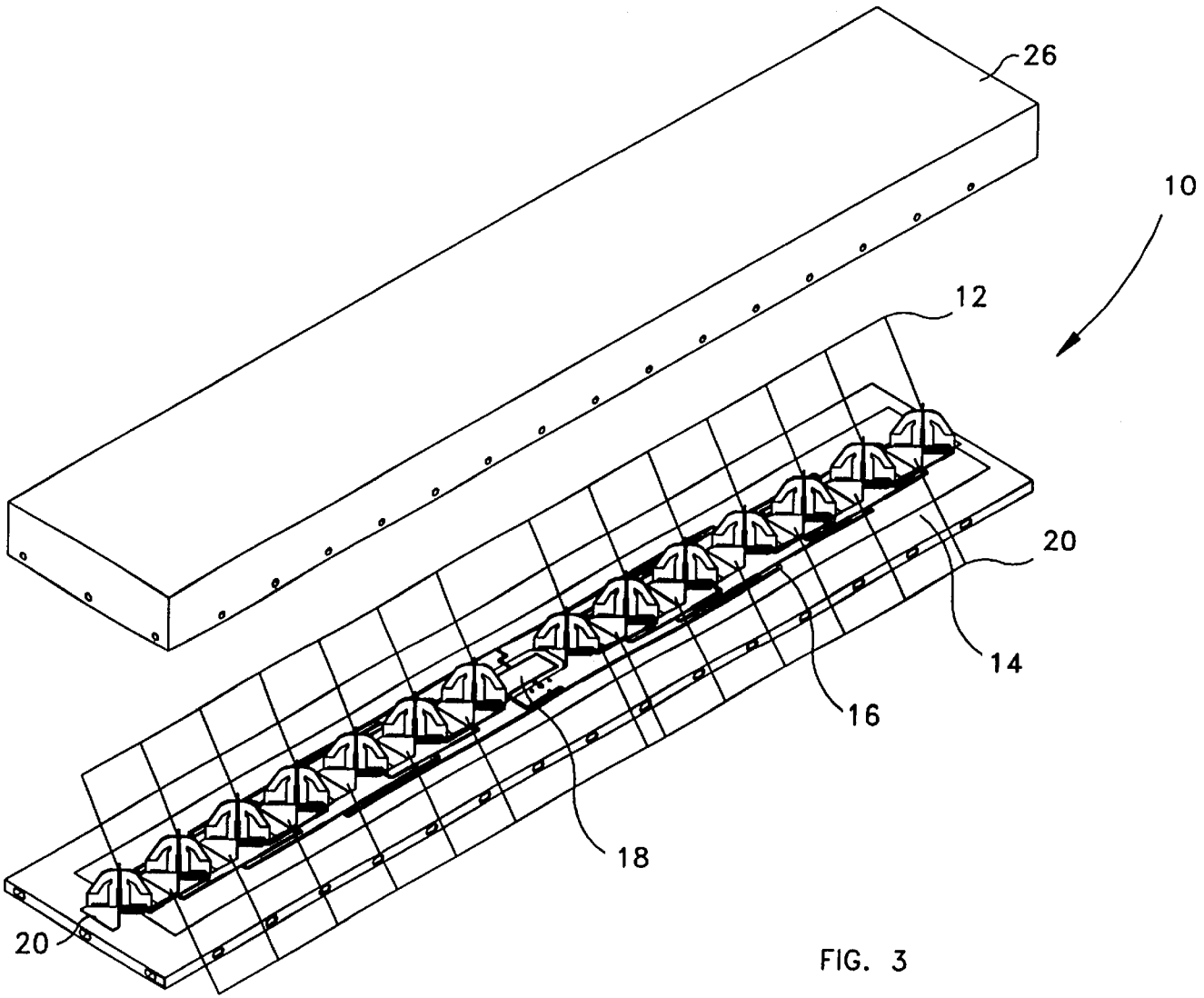
FIG. 3 is an illustration showing an elevation view of the preferred embodiment of the present invention.
Figure 4:
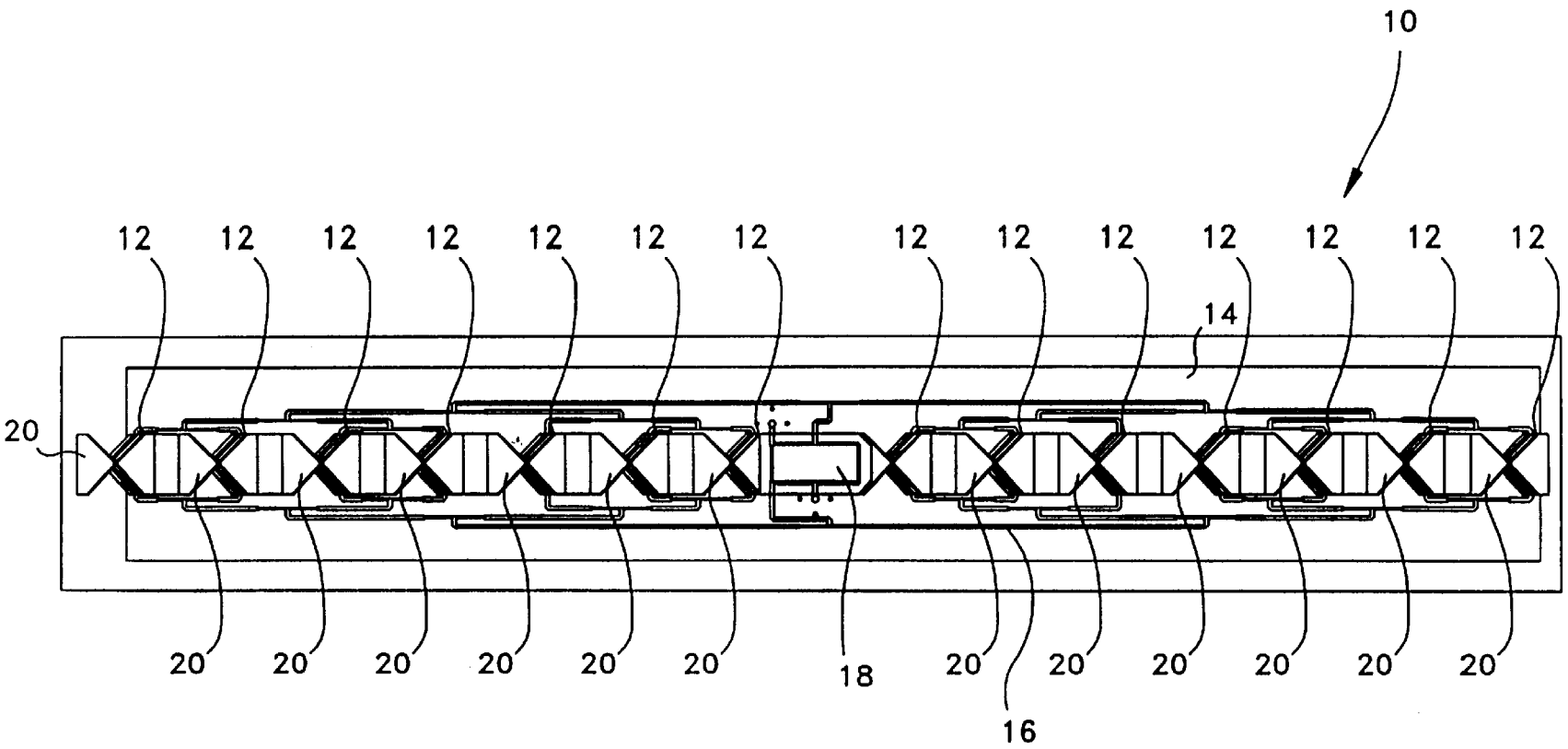
FIG. 4 is an illustration showing a top-down view of the preferred embodiment of the present invention.

FIG. 2 is an illustration showing an exploded representation of the primary components of the antenna 10 to highlight the preferred construction of the antenna. FIGS. 3 and 4, respectively, provide elevation and topface views of the antenna 10. Referring to FIGS. 2–4, each radiating element 12 preferably comprises two dipole antennas, each having a pair of dipole arms and a dipole base, co-located to form a crossed-dipole pair. The crossed-dipole pair have co-located electric centers, thereby minimizing any phase delay associated with feeding these dipole antennas. Each crossed-dipole pair is positioned above the front conductive surface of a radio-electric ground plane provided by the ground plane 14. Specifically, the crossed dipole pair is mounted to the conductive surface of a capacitive plate 20 which, in turn, is attached to the ground plane 14. The crossed-dipole pair is oriented such that the supply for a dipole is located at the dipole base and the vertex of the dipole arms represents the largest distance of separation from the ground plane for any point on the dipole. The dipole arms are swept down towards the ground plane 14 in an inverted "V"-shape. The height of the dipole arms above the surface of the ground plane 14 and the angle of the dipole arms can be optimized to provide a substantially rotationally symmetric radiation pattern characteristic in the forward direction above the ground plane 14. The preferred dimensions of the dipole antenna and its feed line are described in detail below with respect to FIG. 8 for an antenna design having a 90° half-power azimuth beamwidth.

The BFN 16 is supported by the front conductive surface of the ground plane 14 and distributes electromagnetic signals to and from the dipole antennas of the radiating elements 12. The BFN 16 uses a pair of distribution networks for the dual polarized array assembly, one for each polarization state. The BFN 16, which is preferably implemented as a microstrip design, supplies an appropriate impedance match between each radiating element 12 and the PCN 18. In addition, the BFN 16 preferably includes a power divider for distributing signals to each radiating element 12.

The PCN 18, which is supported by the front conductive surface of the ground plane 14, is centrally located in the antenna assembly and is connected between the distribution networks of the BFN 16 and a pair of antenna ports 22 and 24, each of which can be connected to a feed cable. The PCN 18 distributes electromagnetic signals to and from the radiating elements 12 via the BFN 16 and provides a complex (both amplitude and phase) weighting of these signals. For the preferred embodiment, the PCN 18 is implemented as a polarization control mechanism having at least four external interfaces for connection to transmission lines. Two of the four external interfaces connect with the distribution networks of the BFNs 16, and the remaining two external interfaces connect with the antenna ports 22 and 24, which in turn are connected to feed cables for connecting a source to the antenna.

Although the PCN 18 is preferably installed within the antenna assembly, it will be appreciated that the PCN 18 can be located outside of the antenna chassis. If the PCN 18 is not installed within the assembly of the antenna 10, the distribution networks of the BFN 16 can supply an appropriate impedance match between the radiating elements 12 and each feed cable connected to antenna ports 22 and 24. For this implementation, each of the antenna ports 22 and 24 corresponds to one of the two polarization states, thereby suppressing signal reflections along this transmission line. It will be understood that the PCN 18 can be installed either within the assembly of the antenna 10 or outside of the antenna chassis based on the particular application for the antenna. For example, the PCN 18 can be installed at the base receive site, whereas the combination of the radiating elements 12, ground plane 14, and BFN 16 can be installed within an antenna assembly at the antenna site.

The conducting surface of the ground plane 14 serves as a structural member for the overall antenna assembly, as well as the radio-electric ground plane for imaging the dipole elements. The ground plane is preferably implemented as a solid, substantially flat sheet of conductive material. The radio-electric extent of the ground plane 14 in the transverse plane of the antenna array (width) is approximately ⅔ wavelength to facilitate imaging the radiator elements over wide fields of view (typically greater than 60 degrees) without the finite boundary of the conducting ground plane 14 appreciably contributing to the radiation characteristics. When the radio-electric extent of the ground plane 14 satisfies the above criteria, the orientation of the radiating elements 12 may be rotated and aligned with the principal planes of the array without seriously degrading the rotational symmetry of the antenna radiation patterns. Nevertheless, the preferred and optimum orientation is when the natural boresight polarizations are 45° with respect to the principal planes of the array.

Empirically-derived data confirms that larger transverse dimensions cause no significant improvements of the rotational symmetry although generally leads to reduced power in the radiation pattern in the rearward direction. For some applications, a low level radiation pattern in the rear direction, termed backlobe region, is desirable and the degree of backlobe reduction is traded with the increased size, weight, cost, and wind loading characteristics.

Measurements conducted for a radio-electric ground plane having a smaller transverse dimension indicate that this smaller width can cause undesirable pattern beamwidth dispersion when the transverse extent is approximately 1.5 wavelength. Yet even smaller transverse extents of a ground plane can cause the azimuth beamwidth to become appreciably sensitive to the number of array elements. This disadvantage is accompanied by a divergence in the desired rotationally symmetrical radiation patterns.

Measurements have also demonstrated that the radio-electric extent of the ground plane 14 in the transverse plane of the array can be made significantly smaller than the above-specified criteria without the azimuth beamwidth being appreciably sensitive to the dimensions over a wide range of smaller values for the case of a vertically-oriented radiator, aligned with the plane of the array. However, this same independence cannot be accomplished for a horizontally polarized component (physical or synthesized via the PCN). Because the need for dual polarization states exists in this application, preferably with co-located electric centers, it is necessary that the size criteria be applied to both polarizations, where the conditions for the horizontal component is the determining factor.

A protective radome 26 comprising a thermoplastic material can be used to enclose the combination of the array of radiating elements 12, the BFN 16, the PCN 18, each capacitive plate 20, and the front conductive surface of the ground plane 14. The radome 26 is attached to the periphery of the ground plane 14 by use of the fasteners 28 and extends around the front surface of the ground plane 14 and the elements mounted thereon. The encapsulation of the antenna within a sealed enclosure formed by the ground plane 14 and the radome 26 protects the antenna elements from environmental effects, such as direct sunlight, water dust, dirt, and moisture. The radome 26 preferably comprises a thermoplastic material marketed by the Kleerdex Company of Aiken, S.C. under the brand name "KYDEX", such as the "KYDEX 100" acrylic PVC alloy sheet.

Figure 5:
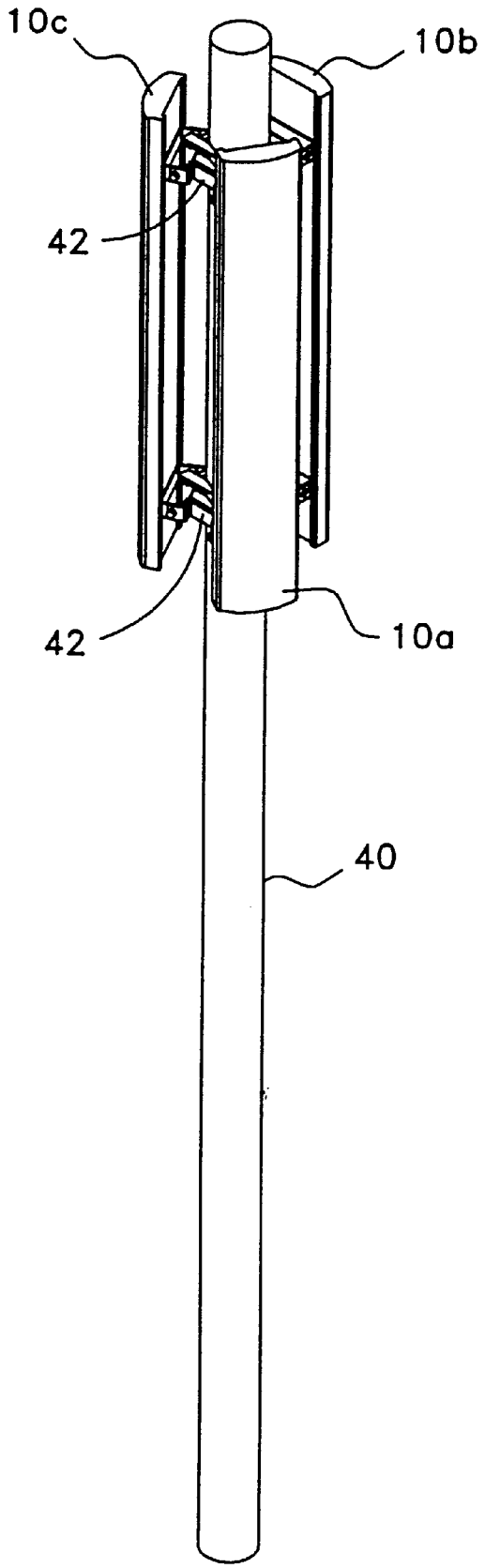
FIG. 5 is an illustration showing a typical mounting arrangement for an antenna provided by the preferred embodiment of the present invention.

The antenna can be mounted to a mounting post via a pair brackets 30, which are attached to the rear conductive surface of the ground plane 14. A u-shaped clamp (not shown) can be used in combination with the brackets 30 to attach the antenna assembly to a mounting post. Although the preferred mounting arrangement for the antenna 10 is via a single mounting post, it will be understood that a variety of other conventional mounting mechanisms can be used to support the antenna 10, including towers, buildings or other free-standing elements. A typical installation of the antenna 10 is shown in FIG. 5, which will be described in more detail below.

The antenna ports 22 and 24, which are preferably implemented as coaxial cable-compatible receptacles, such as N-type receptacles, are connected to the rear surface of the ground plane 14 via the capacitive plates 32 and 34. Each capacitive plate 32 and 34 includes the combination of a conductive sheet and a dieletric layer positioned adjacent to and substantially along the extent of the conductive sheet. When mounted to the antenna assembly, the conductive sheet is positioned adjacent to the coaxial cable-compatible receptacle of each port 22 and 24, whereas the dialectic layer is sandwiched between the rear surface of the ground plane 14 and the conductive sheet. In this manner, the radio-electric connection of the current path between the antenna ports 22 and 24 and the ground plane 14 is achieved via "capacitive coupling". The conductive sheet has sufficient area to provide a low impedance path at the frequency band of operation. The dielectric layer serves as a direct current (DC) barrier by preventing a direct metal-to-metal junction contact between the antenna ports 22 and 24 and the ground plane 14. This type of capacitive coupling, which is used to reduce passive intermodulation effects, is described in more detail within the specification of U.S. Patent application Ser. No. 08/396,158, filed Feb. 27, 1995, which is owned by a common assignee, and is hereby incorporated by reference.

The antenna shown in FIGS. 2–4 is primarily intended to support communications operations within the Personal Communications Services (PCS) frequency range of 1850–1990 MHz. However, those skilled in the art will appreciate that the antenna dimensions can be "scaled" to support typical cellular telephone communications applications, preferably operating within the band of approximately 805–896 MHz. Likewise, the design of the antenna can be scaled to support European communications application, including operation within the Global System for Mobile Communications (GSM) frequency range of 870–960 MHz or the European PCS frequency range of 1710–1880 MHz. These frequency ranges represent examples of operating bands for the antenna; the present invention is not limited to these frequencies ranges, but can be extended to frequencies both below and above the frequency ranges associated with PCS applications.

Significantly, the antenna 10 shown in FIGS. 1–4 provides a planar array of radiating elements having dual polarization states and having substantially rotationally symmetric radiation patterns for a wide field of view. For example, the illustrated antenna design has a 90 degree HPBW within the azimuth plane of the antenna, which is achieved by the combination of the dual-polarized radiators and the ground plane. In contrast, the half-power beamwidth for the elevation plane is predominately achieved by the size of the antenna array, i.e., the number of radiating elements within the planar array and the interelement spacing. Although the antenna illustrated in FIGS. 1–4 exhibits a 90 degree HPBW, other embodiments exhibit an HPBW beamwidth selected from a range between 45 degrees and 120 degrees. Significantly, an implementation of the antenna 10 can exhibit substantially rotationally symmetric radiation patterns for an HPBW of at least 45 degrees.

FIG. 5 is an illustration showing a typically installation of the antenna 10 for operation as an antenna system for a PCS system. As emphasized in FIG. 5, the antenna 10 is particularly useful for sectorial cell configurations where the azimuth coverage is divided into K distinct cells. For this representative example, a tri-sectored (K=3) site having three antennas, antennas 10*a*, 10*b*, and 10*c*, centered at the base station, each with 120° (radians) coverage in azimuth and an effective coverage radius determined by the antenna gain, height, and beam downtilt. The antennas 10*a*, 10*b*, and 10*c* are mounted to a mounting pole 40 via top and bottom mounting brackets 42 attached to the rear surface of each antenna. Although FIG. 5 illustrates the use of a pole mounting for the antenna 10, it will be appreciated that mounting hardware can be used for flush mounting of the antenna assembly to the side of a building, as well as cylindrical arrangements for mounting the assembly to a pole or a tower.

The example of FIG. 5 illustrates that site conversion from space diversity to polarization diversity results in the replacement of the large antenna structure commonly associated with the requirement to physically separate the antennas. With the polarization diversity characteristics of the preferred antenna, three antenna assemblies can be mounted to a single mounting pole with mounting hardware to achieve tri-sectored coverage. This leads to the significant advantage of a smaller footprint for the antenna assembly, which has a smaller impact upon the visual environment than present space diversity systems.

Figure 6C:
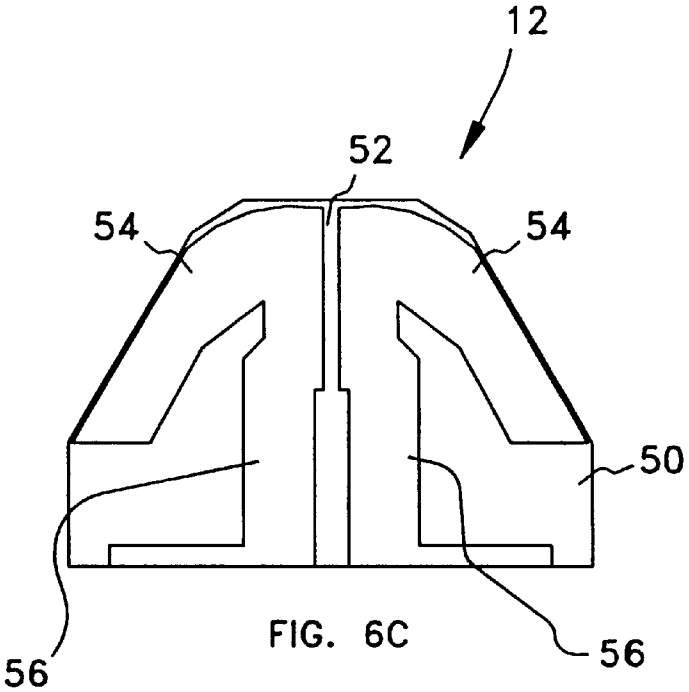
FIGS. 6A, 6B, and 6C, collectively described as FIG. 6, are illustrations showing the alternative faces and a side edge of a dieletric substrate for a radiating element for the preferred embodiment of the present invention.
Figure 6B:
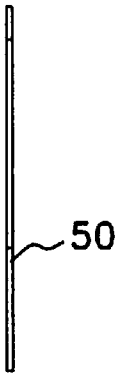
Figure 6A:
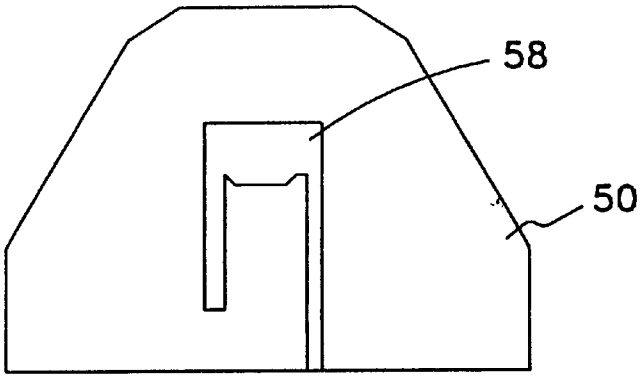

FIG. 6, comprising FIGS. 6A, 6B, and 6C are illustrations respectively showing the front, side, and rear views of a dieletric plate that supports the preferred implementation of a radiating element. Referring first to FIG. 6C, a dipole antenna 52 for each radiating element 12 is formed on one side of a dielectric plate 50, which is metallized to form the necessary conduction strips for a pair of dipole arms 54 and a body 56. The dipole antenna 52 is photo-etched (also known as photolithography) on the dielectric substrate of the dielectric plate 50. The width of the strips forming the dipoles arms 54 is chosen to provide sufficient operating impedance bandwidth of the radiating element. The same face occupied by the dipole arms 54 contains the dipole body 56, which comprises a parallel pair of conducting strips electrically connecting the dipole arms 54 to the capacitive plate 20 (FIG. 2). The capacitive plate 20, which will be described in more detail below with respect to FIG. 9, serves as a mechanical support and operates as a radio-electric connection for connected the crossed dipole pair to the conductive surface of the ground plane 14. The length of these conducting strips from the crossing location of a feed line 58 (FIG. 6A) on the opposite face of the dielectric plate is approximately one-quarter wavelength at the center frequency of the selected operating band and serves as a balun. The width of these conducting strips increases approaching the dipole element base in order to provide an improved radio-electric ground plane for the microstrip feed line 58 (FIG. 6A) on the opposite face of the dielectric plate.

On the face opposite the dipole antenna 52, as shown in FIG. 6A, is the feed line 58, which has a microstrip form that couples energy into the dipole arms 54 (FIG. 6C). As before, the microstrip feed line 58 is photo-etched on the surface of the dielectric plate 50. The feed line 58 is terminated in an open circuit, wherein the open end of the feed line is approximately one-quarter wavelength long as measured from the crossing location at the center frequency of the operating band. The preferred embodiment of the feed line 58, which runs from the base of the dipole antenna 52 (FIG. 6C) to the region near the crossover, presents a 50 Ohm impedance.

As shown in the side view of FIG. 6B, the dielectric plate 50 is a relatively thin sheet of dielectric material and can be one of many low-loss dielectric materials used for the purpose of radio circuitry. The preferred embodiment is a material known as MC-5, which has low loss tangent characteristics, a relative dielectric constant of 3.26, is relatively non-hydroscopic, and relatively low cost. MC-5 is manufactured by Glasteel Industrial Laminates, a division of the Alpha Corporation located in Collierville, Tenn. Lower cost alternatives, such as FR-4 (an epoxy glass mixture) are known to be hydroscopic and generally must be treated with a sealant to sufficiently prevent water absorption when exposed to an outdoor environment. Water absorption is known to degrade the loss performance of the material. Higher cost Teflon based substrate materials are also likely candidates, but do not appear to offer any compelling advantages.

Although each radiating element 12 is preferably a printed implementation of a dipole antenna, it will be understood that other implementations for the dipole antenna can be used to construct the antenna 10. Other conventional implementations of dipole antennas can also be used to construct the antenna 10. Moreover, it will be understood that the radiating element 12 can be implemented by antennas other than a dipole antenna.

Figure 7B:
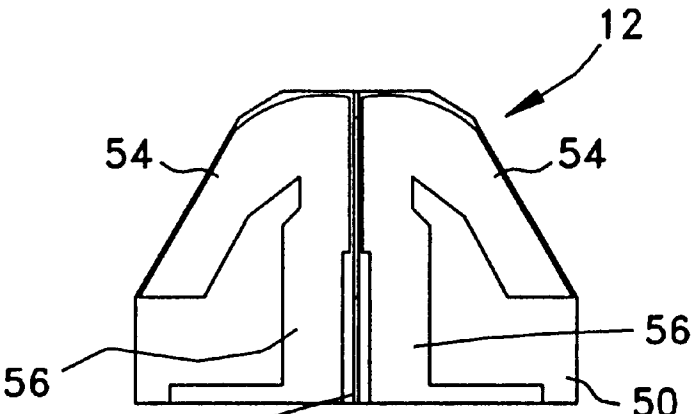
FIGS. 7A, 7B, 7C, and 7D, collectively described as FIG. 7, are illustrations showing side and perspective views of a radiating element for the preferred embodiment of the present invention.
Figure 7D:
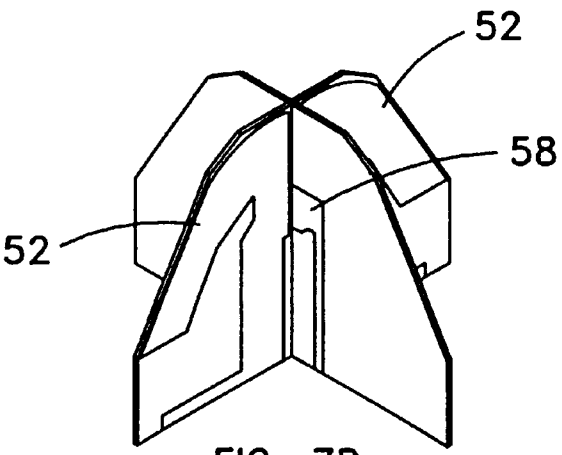
Figure 7A:
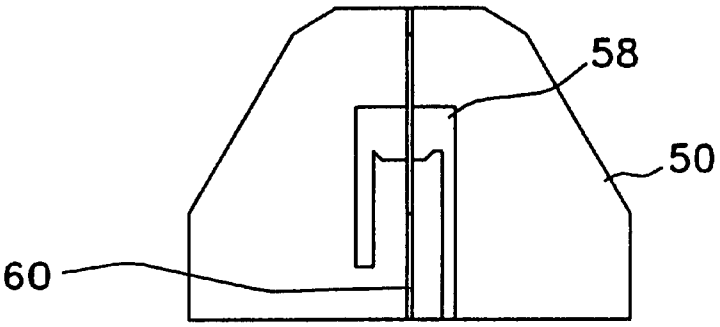
Figure 7C:
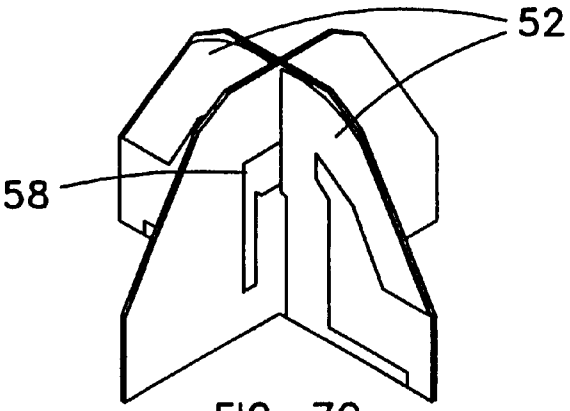

FIGS. 7A, 7B, 7C, and 7D, collectively described as FIG. 7, are illustrations of various views of the crossed dipole pair. Turning first to FIGS. 7A and 7B, each dieletric plate 50 includes a slot 60 running along the center portion of the plate and within a nonmetallized portion of the dielectric substrate that separates the parallel strips of the dipole body 56. A set of interleaving slots 60 in a pair of the dielectric plates 50 facilitate crossly orienting the pair physically the pair of dipole antennas 52 orthogonal with respect to each other. As shown in FIGS. 7C and 7D, the microstrip feed lines 58 alternate in an over-under arrangement within the cross-over region to prevent a conflicting intersection of the two feed lines. The crossly oriented dipole antennas 52 are largely identical in the features except for the details near the crossover region of the feed lines 58. The differences in strip width of the dipole body 56 provide effectively the same impedance match characteristics of the reference location at the base of the radiating element.

Figure 8:
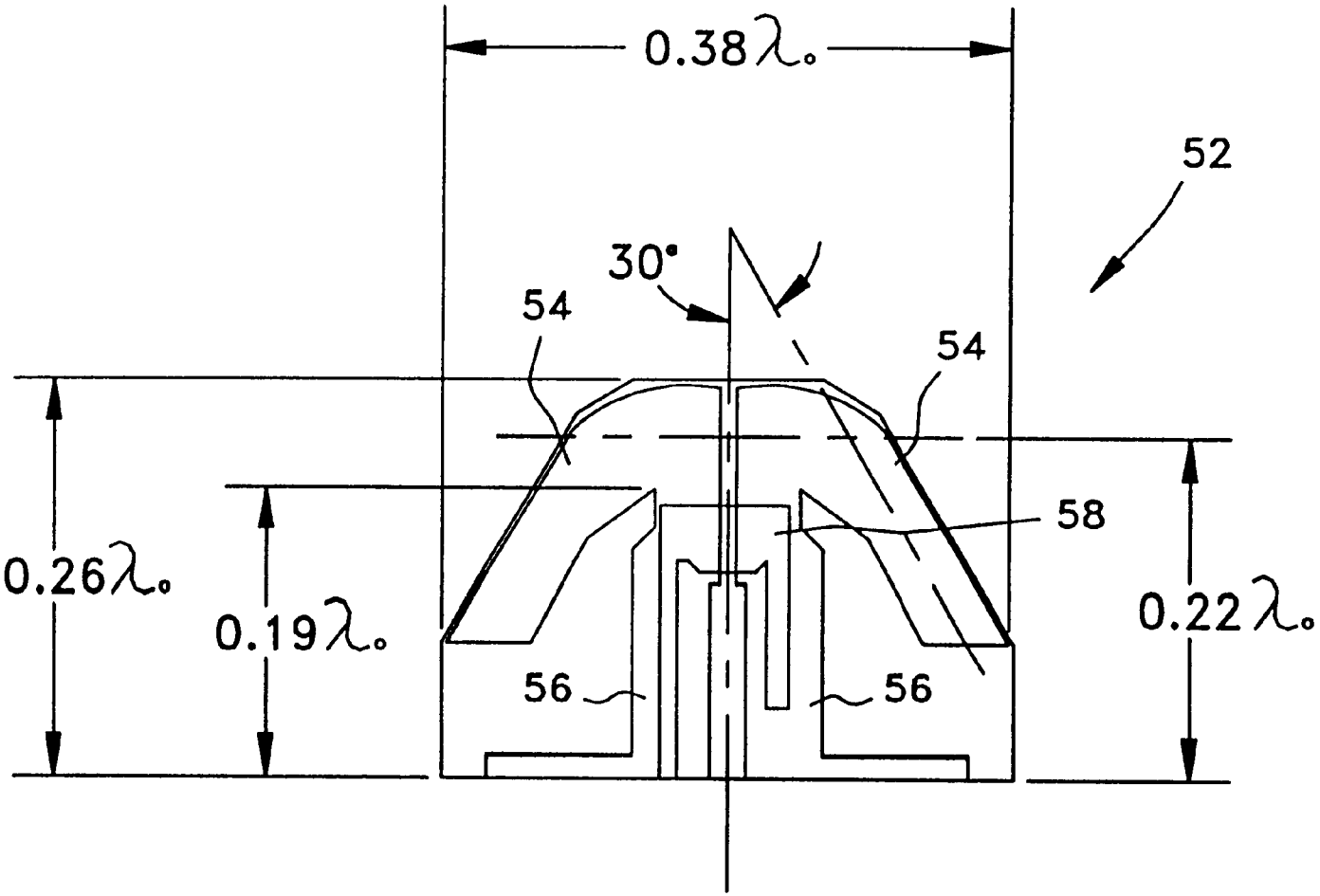
FIG. 8 is an illustration showing the dimensions of a radiating element for the preferred embodiment of the present invention.

Referring now to FIG. 8, which shows the preferred dimensions of the dipole antenna configuration for the PCS frequency spectrum, each radiating element 12 includes dipole arms 54 having a swept down design to form an inverted "V"-shape. When mounted, the height of the dipole arms above the ground plane 14 is approximately 0.26 wavelength. The angle of the dipole arms 54 is approximately 30 degrees. The pair of dipoles arms 54 has a overall span extending approximately one-half wavelength and a width of approximately 0.38 wavelength. The height of the vertex of the lower edge of the dipole arms 54 and the body 56 is 0.19 wavelength. The height of the centroid of the dipole arms 54 near the vertex of the dipole antenna 52 is approximately 0.22 wavelength. It will be appreciated that the width of the dipole arms 54 is predominately determined from frequency bandwidth considerations. For example, a narrow dipole arm generally results in a smaller operating impedance bandwidth. In addition, it will be understood that the details of the geometry for the vertex of the lower edge of the dipole arms 54 and the body 56 do not appreciably influence antenna performance other than impedance characteristics.

Figure 9B:
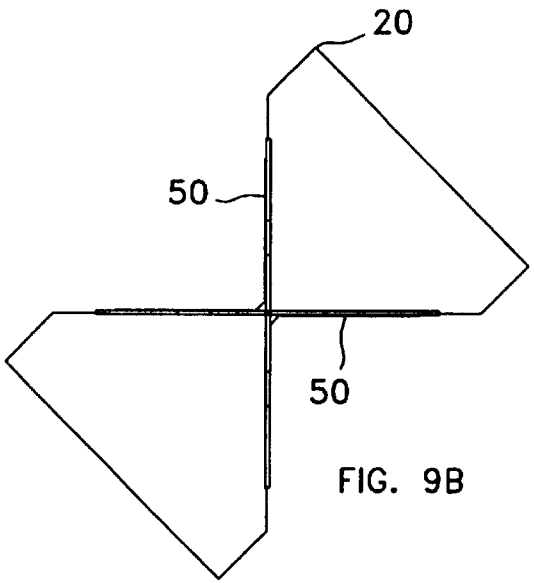
FIGS. 9A, 9B, 9C, and 9D, collectively described as FIG. 9, are illustrations showing side, top-down, and perspective views of a combination of a radiating element and a mounting plate for the preferred embodiment of the present invention.
Figure 9D:
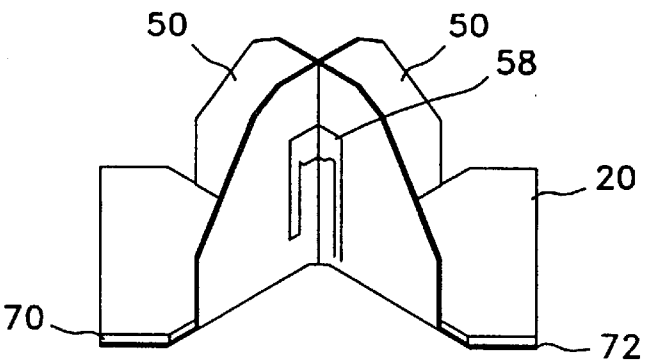
Figure 9A:
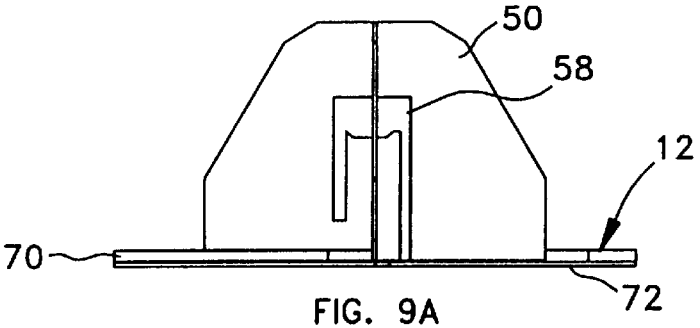
Figure 9C:
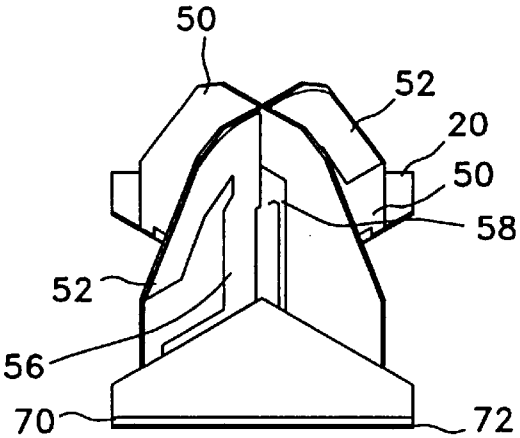

FIGS. 9A, B, C, and D, collectively described as FIG. 9, are illustrations showing various view of the preferred mechanism for mounting the crossed pair of radiating elements to the radio-electric ground plane. Referring to FIG. 9, the radio-electric connection of the current path between each dipole 52 and the ground plane 14 is through a capacitively-coupled connection. Specifically, a capacitive plate 20 is used to connect each dipole 52 of a crossed-dipole pair to the conductive surface of the ground plane 14. The plates may be ganged together to ease manufacturing. The capacitive plate 20 has a conductive plate 70 and a dielectric layer 72. The conductive plate 70 has sufficient conductive surface area to provide a low impedance path at the frequency band of operation. The thin dielectric layer 72 supports the dual functions of providing a direct current (DC) barrier and operating as a double-sided adhesive for mechanically restraining the position of the crossed-dipole pair assembly on the ground plane 14. The capacitive plate 20 prevents a direct metal-to-metal junction contact, which is considered a potential source of passive intermodulation frequency products during operation at high radio power level, such as several hundred Watts.

The preferred conductive plate 70 is a tin-plated, brass sheet formed to the shape desired for both mechanical support of the cross-radiator pair and having structural features for soldering the electrical connection of the conducting strips interconnecting the capacitive plate to the strips of the dipole body. For the preferred embodiment, which is designed for PCS operations, the thickness of the conductive plate 70 is approximately 0.010–0.020 inches. The dielectric layer 72 is preferably implemented by a dielectric material supplied by a double-sided transfer adhesive known as Scotch VHB, which is marketed by 3M Corporation of St. Paul, Minn. For the preferred embodiment, the selected dielectric material is 0.002 inches thick and at least as wide as the capacitive plate, preferably trimmed to the width of the capacitive plate.

Figure 10:
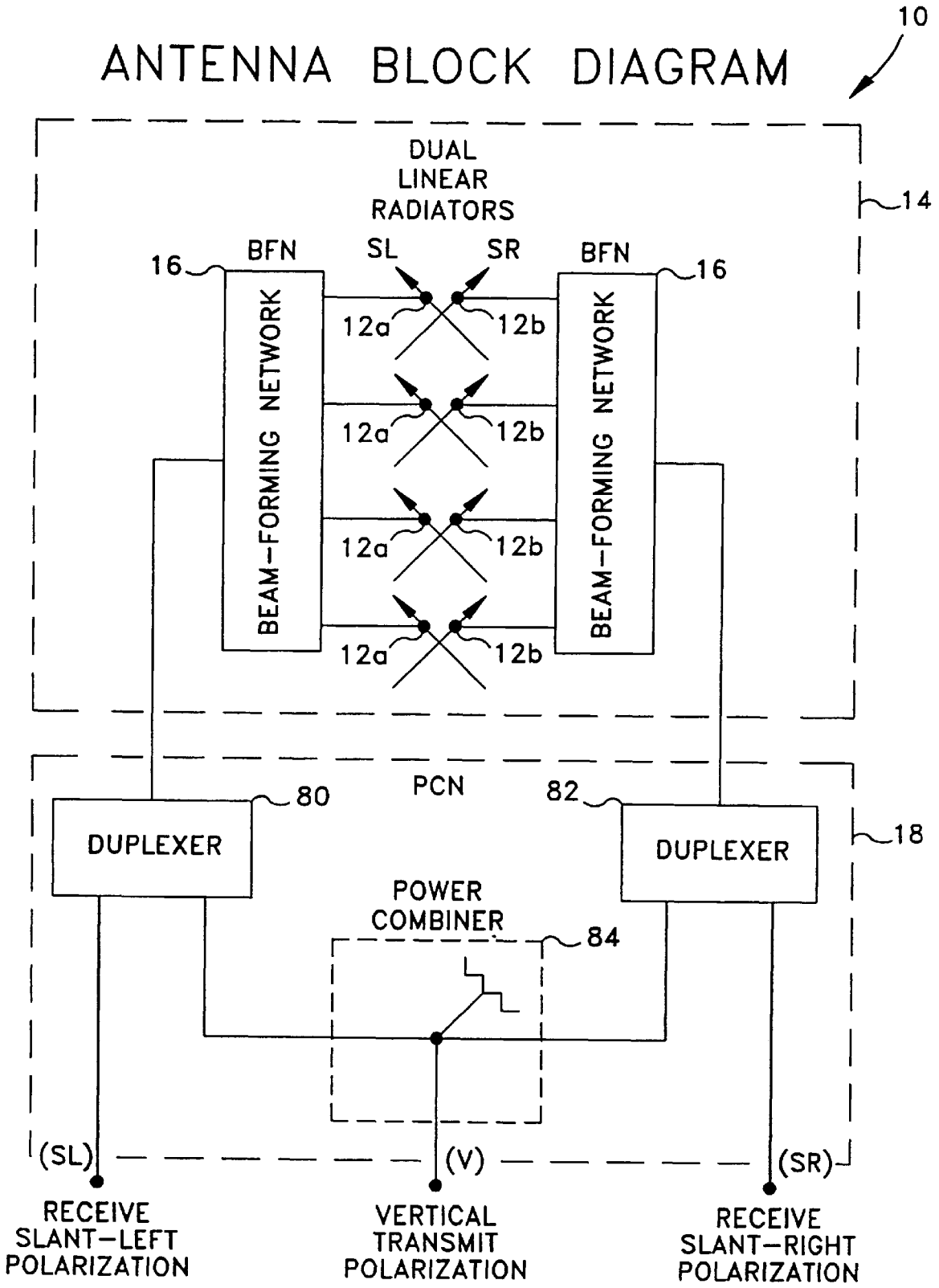
FIG. 10 is a block diagram illustrating a polarization control network for the preferred embodiment of the present invention.

FIG. 10 is a block diagram illustrating the preferred components for the PCN of the antenna 10. Referring now to FIG. 10, the preferred PCN comprises a pair of duplexers 80 and 82 and a power combiner 84. Each of the duplexers 80 and 82 is connected between the BFN 16 and the power combiner 84. In particular, the duplexer 80 is connected to the distribution network for the radiating element 12 having a slant left polarization state, whereas the duplexer 82 is connected to the distribution network for the radiating element 12 having a slant right polarization state. In response to a receive signal having a slant left polarization state from the BFN 16, the duplexer 80 outputs the receive signal via an output port. The duplexer 82 outputs via an output port a receive signal having a slant right polarization in response to the receive signal from the BFN 16. The power combiner 84 accepts a transmit signal from a transmit source and distributes this transmit signal to the duplexer 80 and to the duplexer 82. The duplexer 80 and the duplexer 82 accept the transmit signal from the power combiner 84 and, in turn, output the transmit signal to the BFN 16. The antenna 10 effectively radiates a vertical polarization state resulting from equal in-phase excitation of the two basic polarizations.

Figure 11:
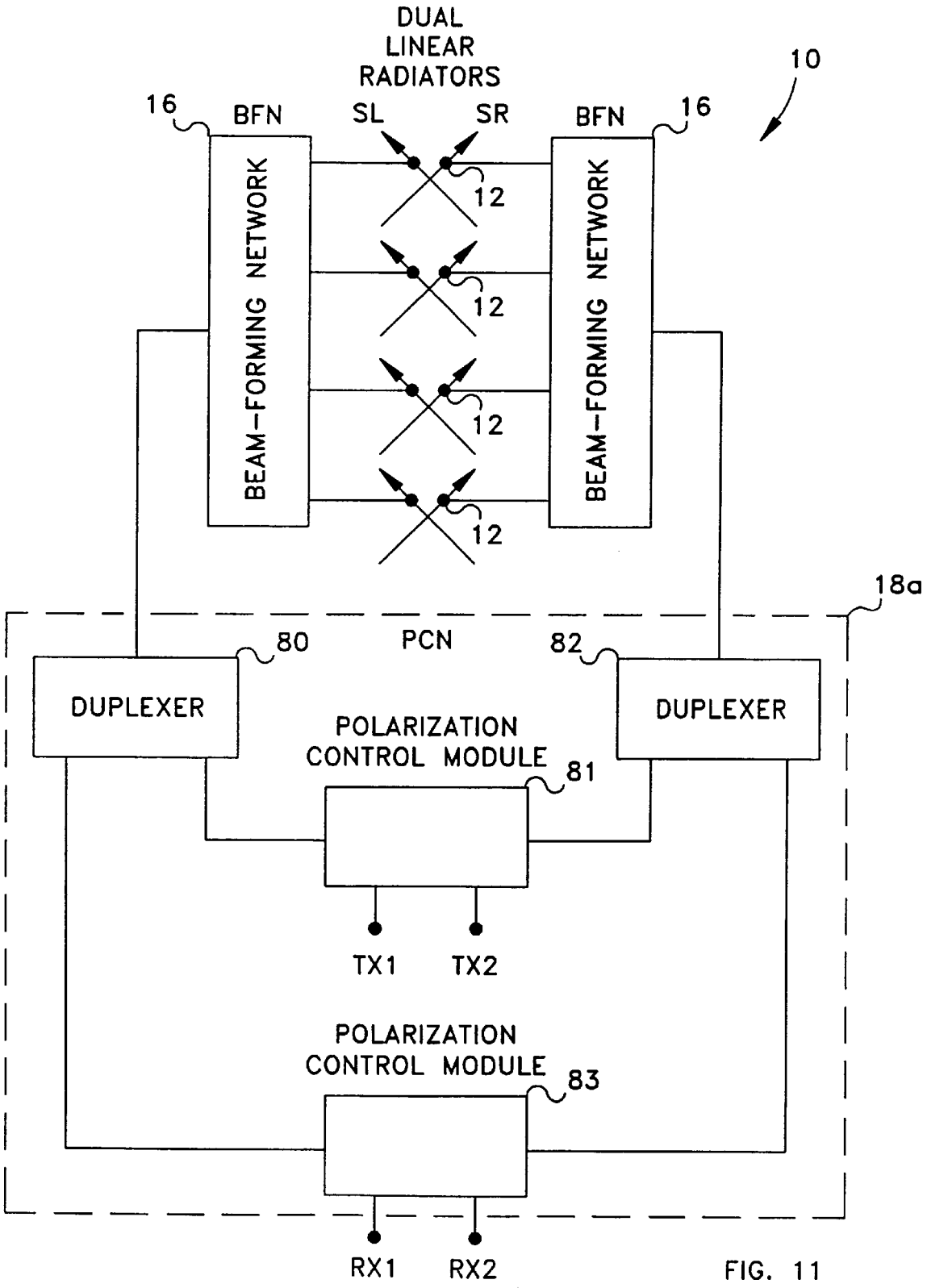
FIG. 11 is a block diagram illustrating a polarization control network for an alternative embodiment of the present invention.

It will be appreciated that the antenna 10 is not limited to an application for receive slant right and slant left polarization signals and transmit vertical polarization signals. As shown in FIG. 11, a PCN 18*a* includes a first polarization control module 81 for accepting a pair of transmit signals from a transmit source and a second polarization control module 83 for outputting a pair of receive signals. The first polarization control module 81 and the second polarization control module 83 are connected to the duplexers 80 and 82.

In response to the transmit signals TX1 and TX2, the polarization control module 81 outputs transmit signals to the duplexers 80 and 82. In addition, the duplexers 80 and 82 output receive signals to the second polarization control module 83 which, in turn, outputs receive signals RX1 and RX2. In this manner, the four ports of the pair of duplexers 80 and 82 can be combined to provide desired pairs of transmit and receive signals. The polarization control modules 81 and 83 can be implemented by a 0°/90°-type hybrid coupler, commonly described as a quadrature hybrid coupler, or a 0°/180°-type hybrid coupler, which is generally known as a "rat race" hybrid coupler.

Figure 12:
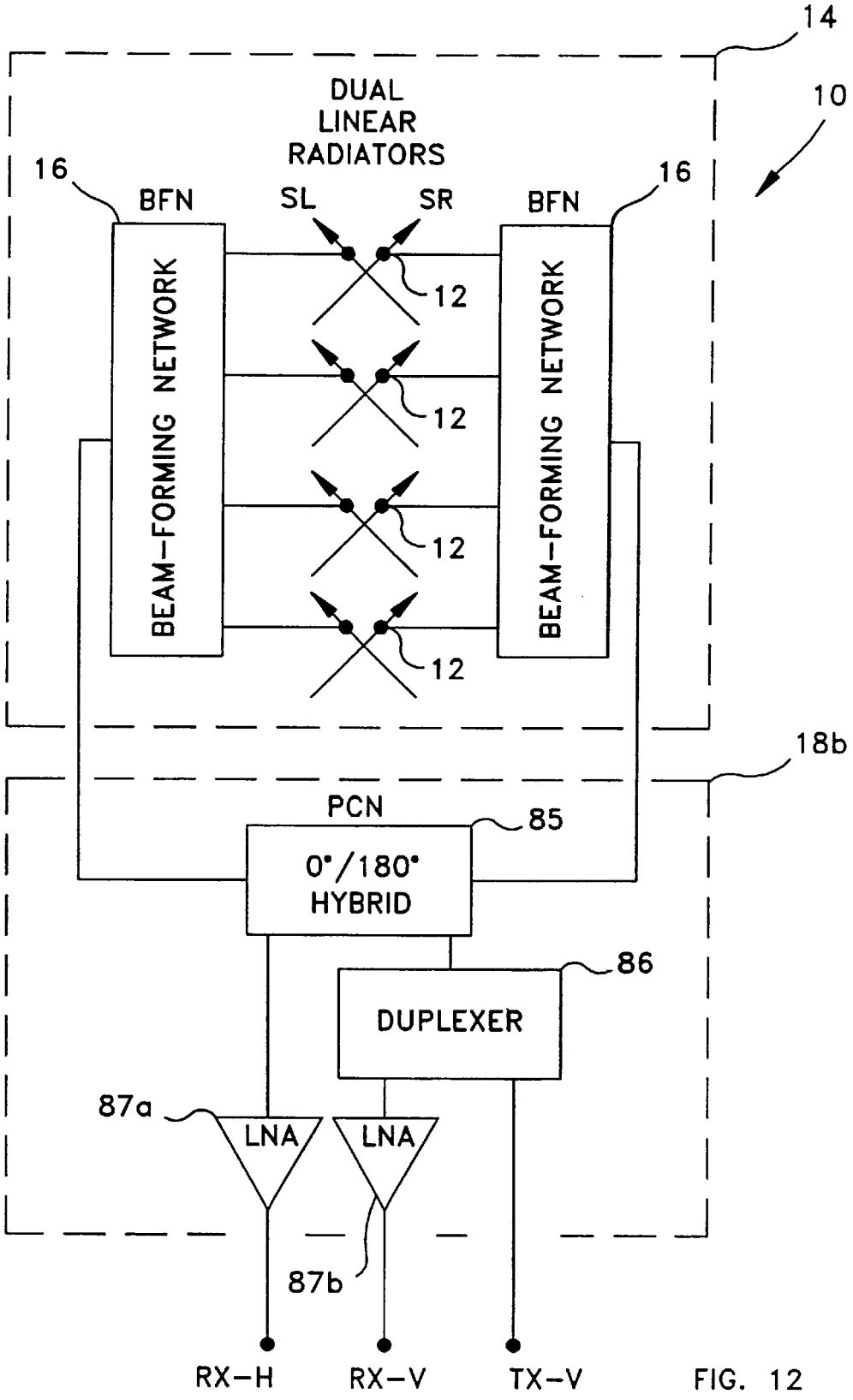
FIG. 12 is a block diagram illustrating a polarization control network for an alternative embodiment of the present invention.

FIG. 12 is a block diagram illustrating another alternative embodiment of a polarization control network. Referring now to FIG. 12, a PCN 18*b* comprises a 0°/180°-type hybrid coupler 85, a duplexer 86, and low noise amplifiers (LNA) 87*a* and 87*b*. The hybrid coupler 85, which is connected to the BFN 16, the duplexer 86, and the LNA 87*a*, transfers signals to and from the distribution networks of the BFN 16. In addition, the hybrid coupler 85 outputs a receive signal having a horizontal polarization state to the LNA 87*a* and a receive signal having a vertical polarization state to the duplexer 86. The duplexer 86 comprises a common port connected to the hybrid coupler 85, receive port connected to the LNA 87*b*, and a transmit port. The common port of the duplexer 86 accepts receive signals having a vertical polarization state from the hybrid coupler 85 and distributes transmit signals having a vertical polarization state to the hybrid coupler 85. The receive port of the duplexer 86 outputs a receive signal having a vertical polarization state to the LNA 87*b*, whereas the transmit port accepts a transmit signal having a vertical polarization state. Consequently, it will be understood that the duplexer 86 is capable of separating receive signals from transmit signals based on the frequency spectrum characteristics of the signals. The LNAs 87*a* and 87*b*, which are respectively connected to the hybrid coupler 85 and the duplexer 86, amplify the received signals to improve signal-to-noise performance. The LNA 87*a* amplifies a receive signal having a horizontal polarization state, whereas the LNA 87*b* amplifies a receive signal having a vertical polarization state. It will be appreciated that the LNAs 87*a* and 87*b* can be eliminated from the construction of the PCN 18*b* in the event that the PCN is positioned at the receiver of the wireless communication system rather than at the antenna site.

A PCN implemented with a hybrid coupler can perform mathematical functions to convert the dual linear slant polarizations (SL/SR) of the preferred embodiment to a vertical/horizontal (V/H) pair or to a right-hand circular/left-hand circular (RCP/LCP) pair, respectively. These polarization conversions can be accomplished without altering the antenna azimuth pattern beamwidth of the co-polarized radiating elements when the radiation pattern is rotationally symmetric. A necessary condition for the use of these hybrid couplers to accomplish the polarization conversion operation with invariant beamwidths is that the group electrical paths (phase delay) lengths of the paths corresponding to exciting the natural characteristic polarizations of the antenna array are reasonably well matched. This same matching condition is necessary for the amplitude characteristic.

Figure 13:
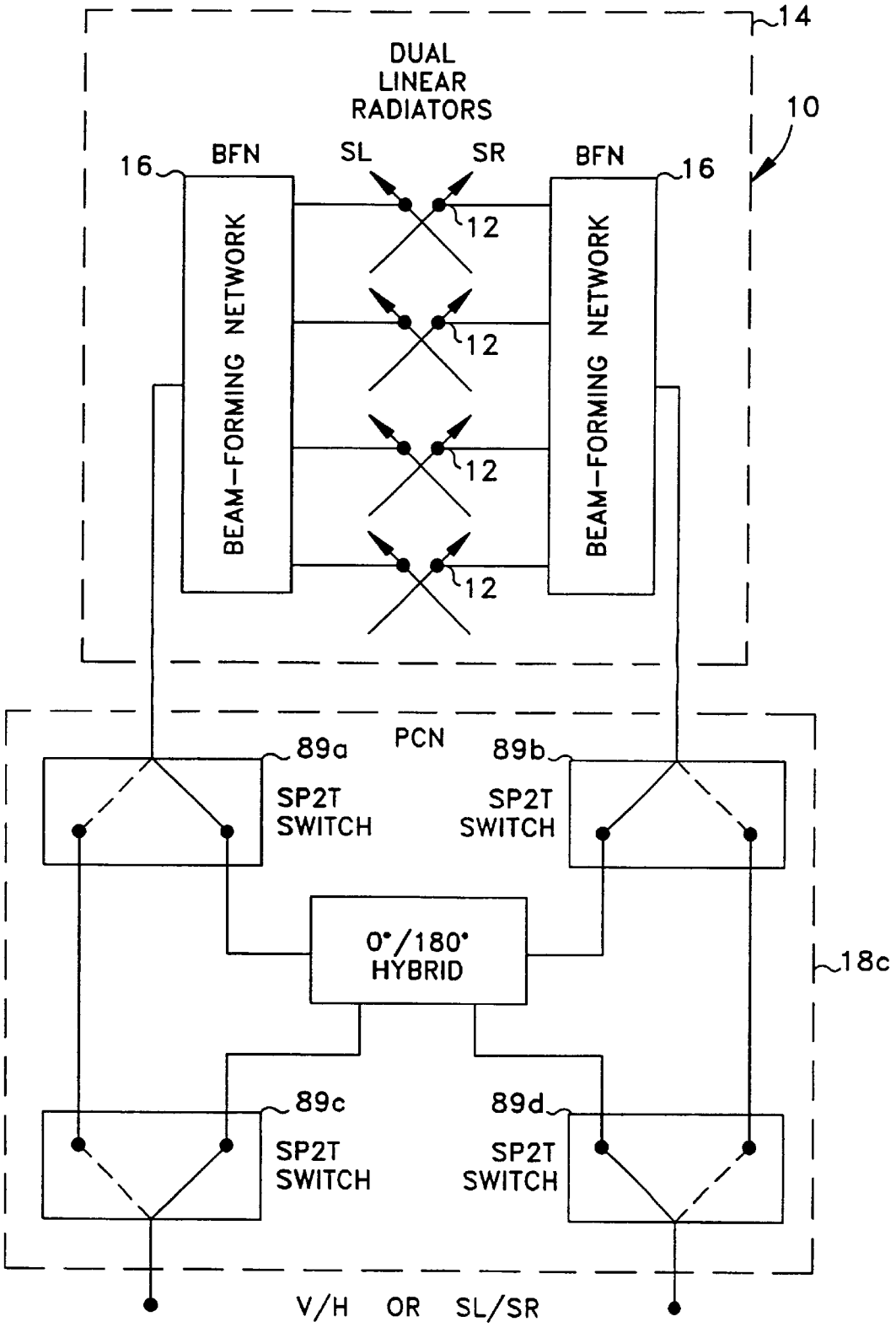
FIG. 13 is a block diagram illustrating a polarization control network for an alternative embodiment of the present invention.

FIG. 13 is a block diagram illustrating another embodiment for the polarization control network. Turning now to FIG. 13, a PCN 18*c* comprises a 0°/180°-type hybrid coupler 88 and switches 89*a–d* to provide four polarization states, specifically vertical, horizontal, slant left, and slant right polarization states, for polarization diversity selection. The common ports of the switches 89*a* and 89*b* are connected to the distribution networks of the BFN 16. In addition, the normally closed ports of the switches 89*a* and 89*b* are connected to the hybrid coupler 88, whereas the normally open ports are directly connected to the switches 89*c* and 89*d*. In similar fashion, the normally closed ports of the switches 89*c* and 89*d* are connected to the hybrid coupler 88, whereas the normally open ports are directly connected to the switches 89*a* and 89*b*. The common ports of the switches 89*c* and 89*d* serve as output ports for supplying receive signals having selected polarization states.

For the normally closed state of the switches 89*a–d*, the hybrid coupler 88 is inserted for operation within the PCN 18*c*, whereas the normally open state of the switches 89*a–d* serves to bypass the hybrid coupler 88. Consequently, for the normally open state, the common ports of the switches 89*c* and 89*d* supply receive signals having slant left and slant right polarization states. In contrast, for the normally closed state, the common ports of the switches 89*c* and 89*d* output receive signals having vertical and horizontal polarization states. This allows the user to select the desired polarization state for the receive signals at the base station receiver.

The switches 89*a* and 89*b* can be implemented by single pole, double throw switches, whereas the switches 89*c* and 89*d* can be implemented by single pole, double throw switches or a single pole, four throw switch.

Figure 14:
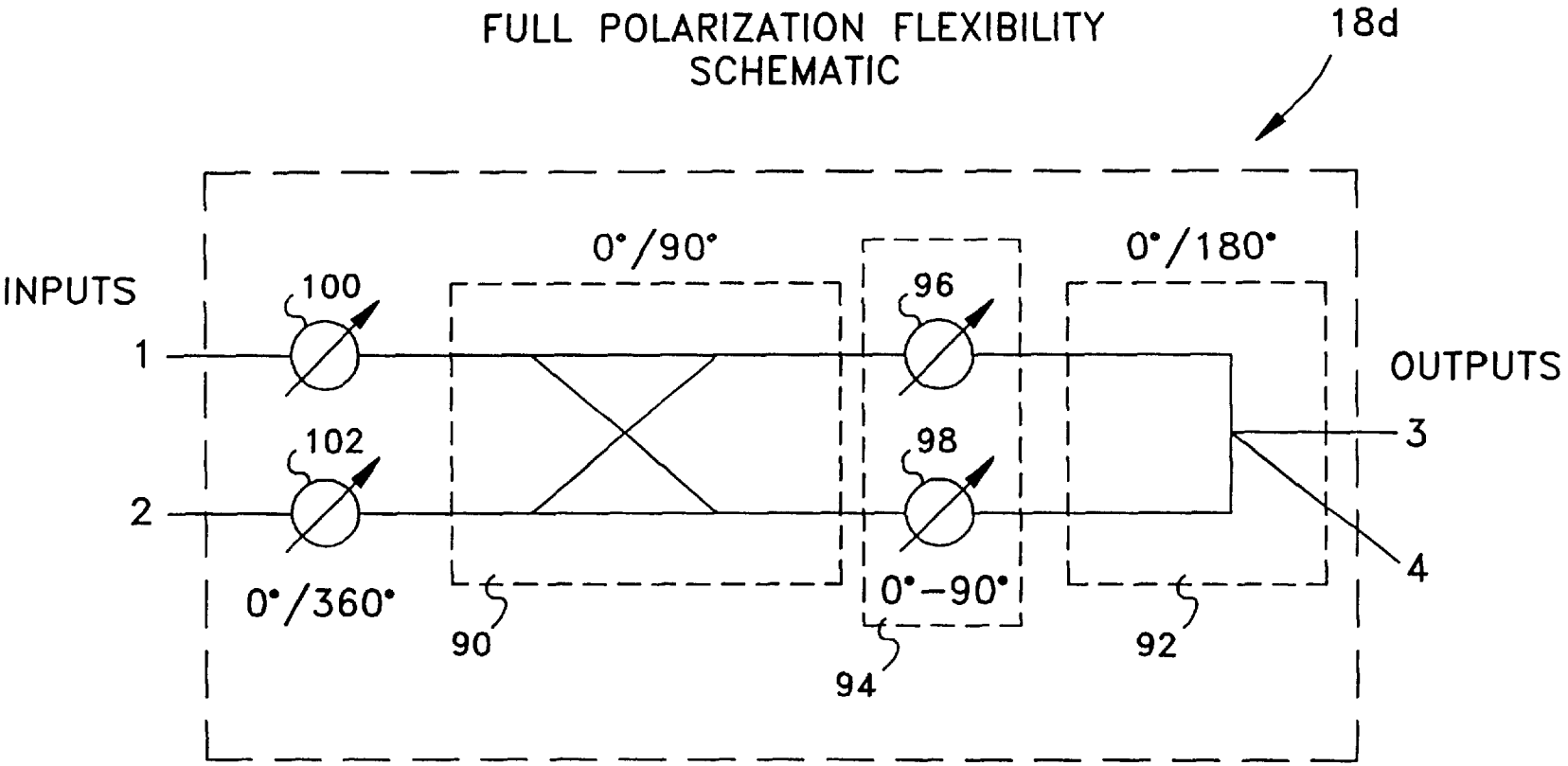
FIG. 14 is a block diagram illustrating a polarization control network for an alternative embodiment of the present invention.

FIG. 14 is a block diagram illustrating an alternative embodiment for a polarization control network. As shown in FIG. 14, a PCN 18*d* involving more than a single component will allow the desired polarization transformation to occur with pattern beamwidth invariance in the presence or condition of amplitude and/or phase imbalance between the two natural polarization components. The PCN 18*d* may be categorized as a variable power distribution network for which the relative phase delay of phase shifters 96 and 98 determines the power distribution between ports of the PCN. The PCN 18*d* comprises a pair of hybrid couplers 90 and 92 interconnected by a transmission module 94 operative to impart an unequal phase delay. The hybrid coupler 90, which is preferably implemented as a 0/90 degree-type hybrid coupler, is functionally connected between the input ports 1 and 2 and the transmission module 94. The hybrid coupler 92, which is preferably implemented as a 0/180 degree-type hybrid coupler, is functionally connected between the output ports 3 and 4 and the transmission module 94. A pair of phase shifters 96 and 98, inserted within the transmission lines of the transmission module 94, provide a phase delay between the hybrid couplers 90 and 92. The phase shifters 96 and 98 can be implemented as unequal lengths of transmission line, i.e., a passive phase shifter or, as shown in FIG. 14, can be variable phase shifters permitting control over the phase delay between the couplers 90 and 92. In addition, a pair of phase shifters 100 and 102 can be inserted between the input ports and the hybrid coupler 90 to permit complete control over the phase of signals entering the PCN 18*d*. This configuration for the PCN 18*d* allows complete polarization synthesis such that any two orthogonal pairs may be produced as the characteristic antenna polarization. If one or more of the passive phase delay units are replaced by a controllable phase shifter, then polarization agility can be implemented with pattern beamwidth invariance.

Referring again to FIGS. 2–4, for PCS frequencies, the radio-electric transverse extent of the ground plane is nominally 10 inches ($5\lambda_0/3$) to achieve the desired polarization performance. When this parameter is "scaled" to lower operating frequencies, for example, to the typical cellular mobile radiotelephone band with a center frequency of 851

MHz, the physical size of the radio-electric ground plane increases. At this typical cellular frequency, the equivalent transverse dimension of the ground plane 14 is approximately 22.5 inches. The dimension in the array plane scales in the same manner to achieve the same antenna directivity value and to conserve the number of array elements. It will be appreciated that it is desirable to minimize the physical transverse dimension to reduce the wind loading and cost, and to improve the general appearance by reducing the antenna size.

Figure 15:
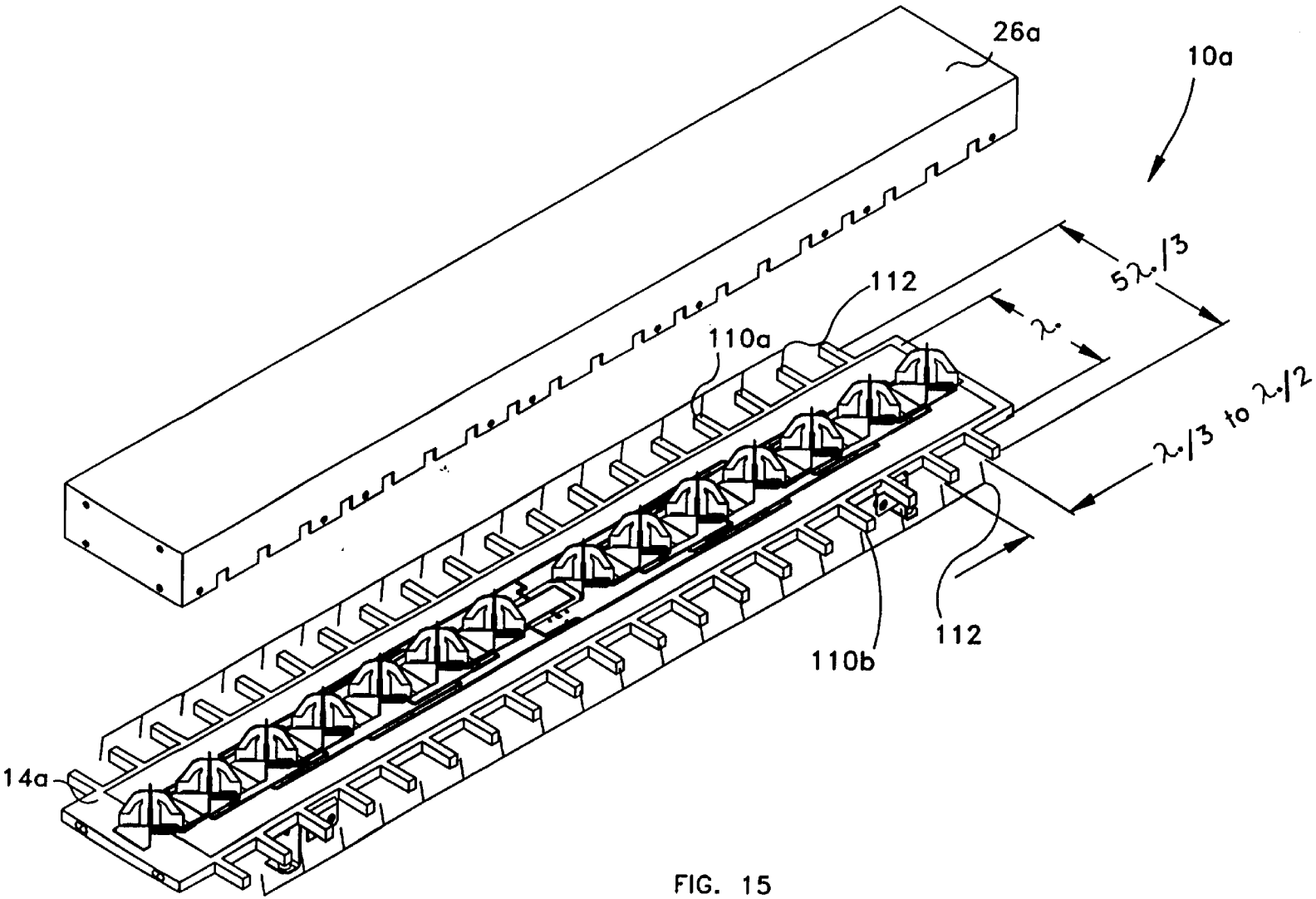
FIG. 15 is an illustration of a radio-electric ground plane for an alternative embodiment of the present invention.

FIG. 15 is an illustration of an alternative embodiment of a ground plane for the antenna 10*a*. Referring to FIGS. 1 and 15, it will be understood that the transverse extent of a radio-electric ground plane is driven by the pattern and polarization characteristics of the horizontal polarization component with respect to the array where the horizontal component lies in the transverse plane. The electromagnetic boundary conditions for the horizontal polarization can be satisfied without significantly influencing the performance of the vertical polarization component. This can be achieved by the use of a non-solid conductive surface beyond the minimum transverse extent needed to achieve the desired performance characteristics for the vertical polarization component. This nonsolid conductive surface, shown in FIG. 15 as grids 110*a* and 110*b*, generally consists of a pair of grids, each having identically-sized, parallel conducting elements 112. The grids 110 and 110*b* are aligned in the horizontal plane of the antenna 10*a* and symmetrically located along the two edges forming the transverse extent of the antenna, i.e., the sides of the ground plane 14*a*. Typical construction techniques for each of the grids 110*a* and 110*b* can be an array of metal wires, rods, tubing, and strips. A radome 26*a* includes slots to accommodate the tips of each of the grid elements 112 for the grids 110*a* and 110*b*.

Measurement data confirms that the perpendicular (vertical) polarized energy is negligibly affected by the grids 110*a* and 110*b* for most geometries. A center spacing (S) of the elements 112 of each grid is approximately $S=\lambda_o/3$ to $\lambda_o/2$. This element spacing enables the grids 110*a* and 110*b* to effectively operate as an extension of the ground plane 14*a* and to avoid introducing a large transmission loss for the parallel (horizontal) polarization component.

If the grid elements 112 are implemented as conductive strips oriented edgewise to the face of the antenna 10*a*, then greater attenuation of the transmitted signal of the parallel polarization component is achieved and the reflectivity of the effective conductive surface increased. Hence, it will be understood that center-to-center spacing can be traded with depth to achieve the desired performance.

At PCS frequencies, empirical measurements have shown that a solid ground plane 14*a* having a transverse extent of 4–6 inches provides good performance for the vertical polarization component. For this physical implementation of the ground plane 14*a*, the grid elements 112 of the pair of horizontally-oriented grid 110*a* and 110*b* should have a length of approximately 2–3 inches to produce the desired polarization and coverage results equivalent to a radio-electric ground plane having a solid conductive surface of 10 inches.

At cellular frequencies with a center frequency of 851 MHz, a solid surface ground plane 14*a* having a nominal transverse extent of 12 inches in combination with a pair of horizontal grids 110*a* and 110*b* having a grid element length of 6 inches is believed to offer a good electrical performance and reasonable wind loading characteristics. Consequently, the preferred configuration for the radio-electric ground plane at 851 MHz uses the hybrid system illustrated in FIG. 15 of a solid conductive surface and a pair of grids aligned adjacent to the solid conductive surface.

An additional benefit of the use of the grids is that the in-phase addition of fields from each section of the edge geometry in the back of the antenna array is partially destroyed, so as to effectively improve the front-to-back ratio pattern envelope performance for most signal polarizations.

At even lower frequencies of operation the use of the array of grid elements becomes more important from the viewpoint of a practical physical implementation. For example, at 450 MHz, the effective transverse radio-electric extent of the ground plane should be approximately 43 inches. By applying the principles of the present invention, the radio-electric ground plane can be implemented as a solid conductive surface of approximately 22 inches in combination with a pair of grid element arrays, each grid element extending approximately 10.5 inches along the length of the parallel sides of the solid conductive surface.

Figure 16:
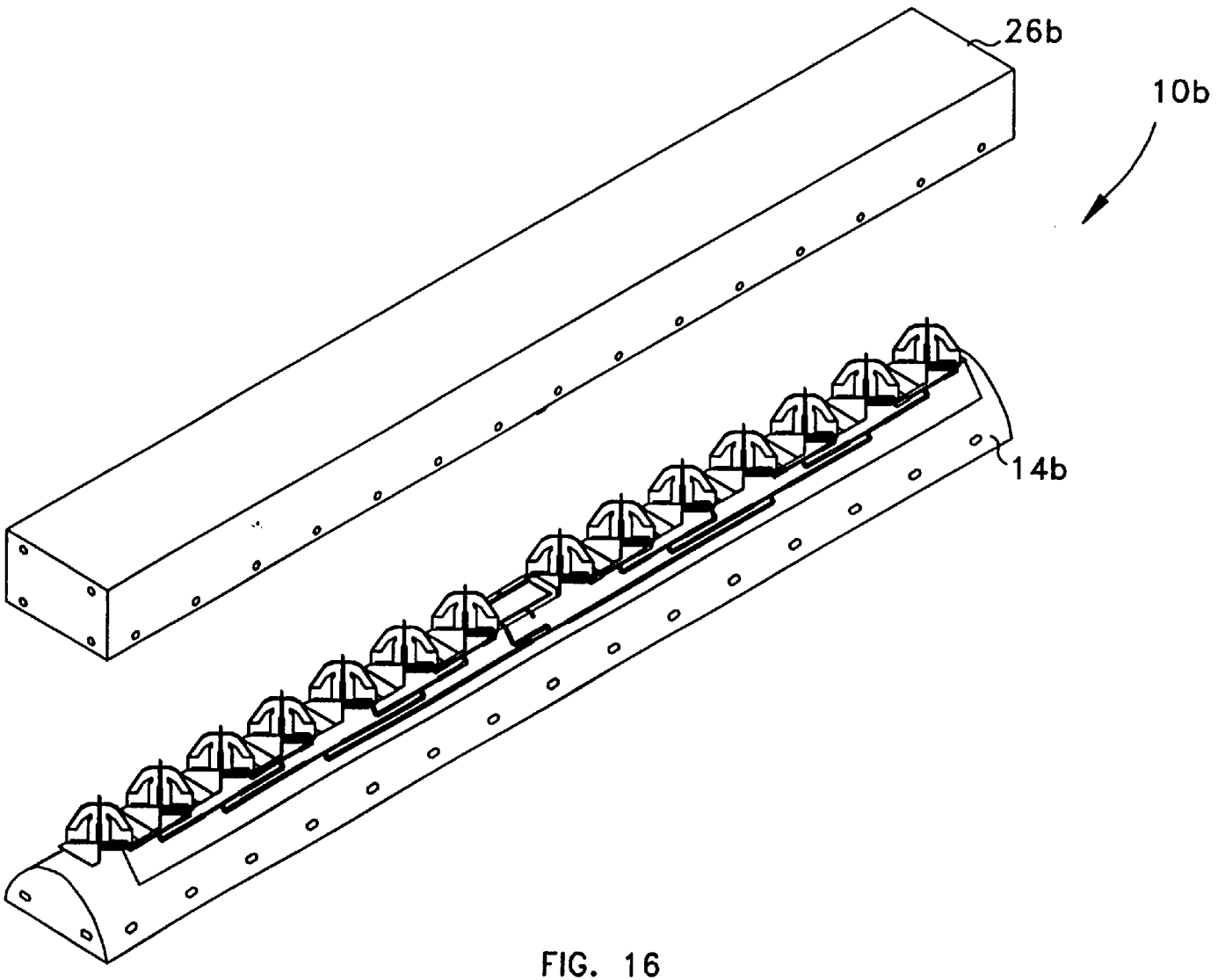
FIG. 16 is an illustration of a radio-electric ground plane for an alternative embodiment of the present invention.
Figure 17:
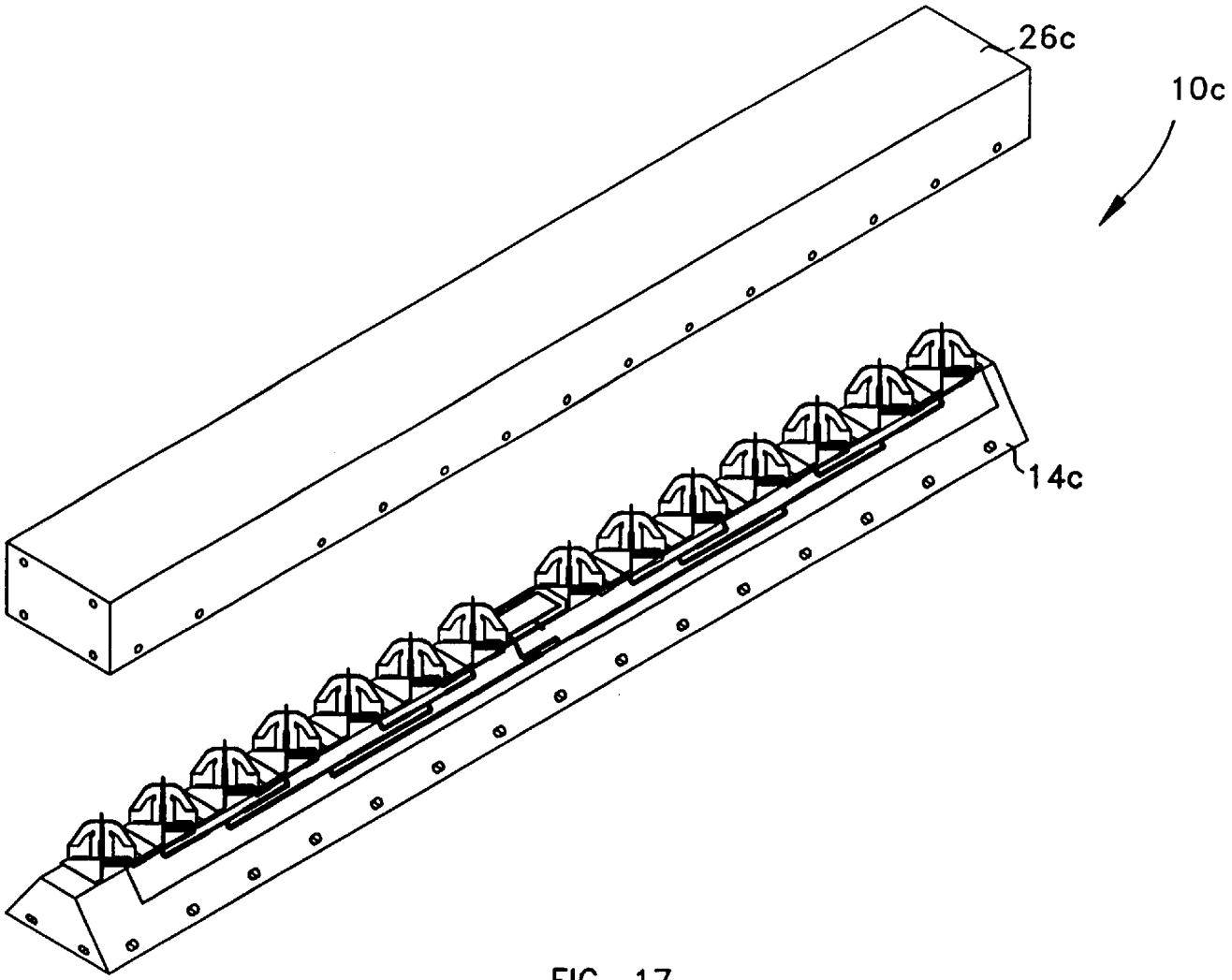
FIG. 17 is an illustration of a radio-electric ground plane for an alternative embodiment of the present invention.

FIGS. 16 and 17 are illustrations showing alternative embodiments of a radio-electric ground plane for use with the antenna of the present invention. Turning now to FIGS. 1, 16, and 17, FIG. 16 illustrates an antenna 10*b* having a "curved" ground plane 14*b*, whereas FIG. 17 illustrates an antenna 10*c* having a piece-wise "curved" ground plane 14*c*. The ground plane 14*b* is a conductive surface having a convex shape, wherein the radiating elements 12, BFN 16, and PCN 18 can be centrally mounted along the vertex of the outer edge of this semi-circle configuration of the radio-electric ground plane. In contrast, a ground plane 14*c* of an antenna 10*c* is a conductive surface having a piece-wise curved shape formed from a center horizontal element and a pair of angled elements extending along each side of the center horizontal element. Although the radiating elements 12 are preferably supported by the horizontal element of the ground plane 14*c*, the BFN 16 and the PCN 18 can be supported by the horizontal surface of the center element and the angled surfaces of the side elements. The curved nature of the ground planes 14*b* and 14*c* are intended to reduce the influence of the finite boundary of the conductive surface of the radio electric ground plane on the radiation characteristics of the antenna.

Figure 18:
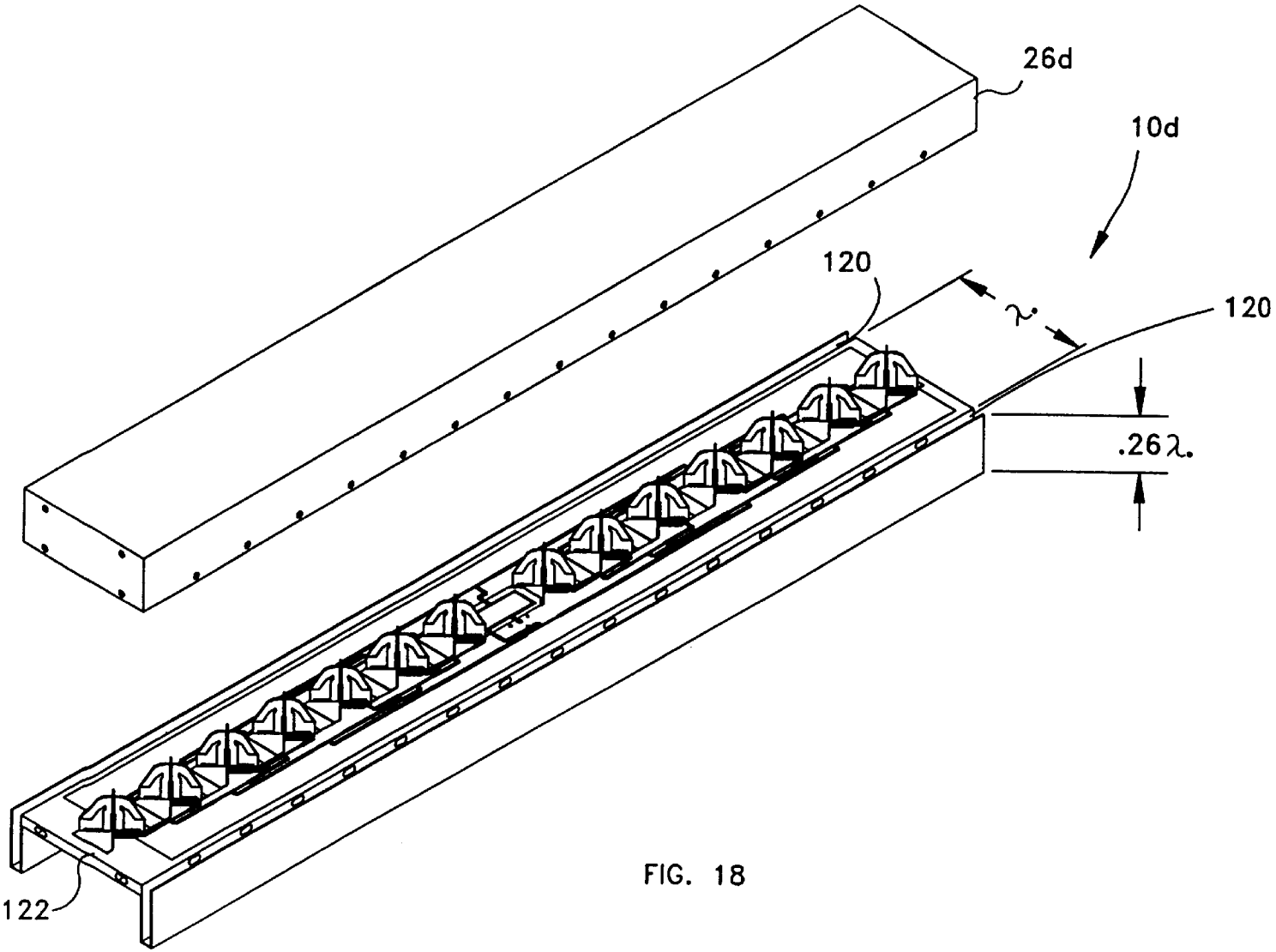
FIG. 18 is an illustration of a radio-electric ground plane for an alternative embodiment of the present invention.

Turning now to FIG. 18, an antenna 10*d* having one or more "choke" grooves 120 of depth of approximately one-quarter wavelength ($\lambda_o/4$) at the center frequency of the operating band along each edge of a solid ground plane 122 can reduce the net edge diffraction coefficient for the horizontal polarization component, and provide coverage pattern and polarization performance similar to a larger radio-electric ground plane. The dimensions of the ground plane 122 may be reduced to approximately one-wavelength ($\lambda_o$), with the opening of the choke groove 120 flush to the plane defined by the surface of the conducting plane of the ground plane 122. The choke groove 120 comprises a section of transmission line of a parallel-plate-type, and shorted at a distance of approximately one-quarter wavelength from the opening. The parallel plate transmission line may be folded around the back surface of the radio-electric ground plane to reduce the depth of the overall assembly. As shown in FIG. 18, a single choke groove 120 along side the major axis of the array is configured in a simple manner perpendicular to the plane and without folding.

There may be beneficial performance improvement from more than one choke groove along the major axis of the antenna. However, the benefit of the size reduction will diminish and approach the full size ($5\lambda_o/3$) ground plane while also adding depth to the assembly for a typical parallel plate width of one-tenth wavelength ($\lambda_o/10$) and two or more grooves per side. The added complexity of the assembly with two or more choke grooves per side is believed unattractive in comparison to the simplicity of the solid or hybrid solid/non-solid ground plane embodiments.

It will be understood that only the claims that follow define the scope of the present invention and that the above description is intended to describe various embodiments to the present invention. In particular, the scope of the present invention extends beyond any specific embodiment described within this specification.

I claim:

1. An antenna system for transmitting and receiving electromagnetic signals having polarization diversity, comprising:

a plurality of dual polarized radiators, characterized by dual simultaneous polarization states, for generating substantially rotationally symmetric radiation patterns defined by a co-polarized pattern response having pseudo-circular symmetry properties and E- and H-plane patterns that are different by no more than approximately 3.1 dB at any value of theta over the field of view for the antenna system; and a distribution network, connected to each of the dual polarized radiators, for communicating the electromagnetic signals from and to each of the dual polarized radiators.

2. The antenna system of claim 1 further comprising a ground plane positioned generally parallel to and spaced apart from the dual polarized radiators by a predetermined distance.

3. The antenna system of claim 2, wherein the polarization states are orthogonal, thereby minimizing the cross-polarization response of any electromagnetic signal received by the antenna system.

4. The antenna system of claim 2, wherein the dual polarization states have electric centers that are co-located within the antenna system.

5. The antenna system of claim 2, wherein the ground plane has sufficient radio-electric extent in a plane transverse to the antenna system to image the dual polarized radiators over a wide coverage area, thereby enabling a radiation pattern within an azimuth plane of the antenna system to be independent of any quantity of the dual polarized radiators.

6. The antenna system of claim 2, wherein each of the dual polarized radiators comprises a crossed dipole pair having a first dipole element and a second dipole element positioned orthogonal to each other.

7. The antenna system of claim 6, wherein the polarization states of the dual polarized radiators are maintained for a wide coverage area (half power beamwidth) of at least 45 degrees in an azimuth plane of the antenna system.

8. The antenna system of claim 6, wherein the dual polarized radiators are positioned along the ground plane to form a linear array, each crossed dipole pair aligned along the ground plane within a vertical plane of the antenna system.

9. The antenna system of claim 6 further comprising a central polarization control network, connected between the distribution network and a pair of antenna ports, for controlling the polarization states exhibited by the dual-polarized radiators.

10. The antenna system of claim 9, wherein the distribution network comprises a first power divider connected to each first dipole element and a second power divider connected to each second dipole element, and the polarization control network comprises a first duplexer, connected to the first power divider and having a first receive port and a first transmit port, and a second duplexer, connected to the second power divider and having a second receive port and a second transmit port, the first receive port outputting a receive signal having a slant left polarization state to one of the antenna ports and the second receive port outputting a receive signal having a slant right polarization state to another one of the antenna ports, the first and second transmit ports connected to a power combiner for accepting a transmit signal having a vertical polarization state.

11. The antenna system of claim 10 wherein the polarization control network further comprises a 0 degree/180 degree hybrid coupler, connected to the first receive port and the second receive port and to the antenna ports, for accepting the slant left polarization receive signal and the slant right polarization receive signal and outputting a receive signal having a vertical linear polarization state to one of the antenna ports and for accepting the slant left polarization receive signal and the slant right polarization receive signal and outputting a receive signal having a horizontal linear polarization state to another one of the antenna ports.

12. The antenna system of claim 10 wherein the polarization control network further comprises a 0 degree/90 degree hybrid coupler, connected to the first receive port and the second receive port and to the antenna ports, for accepting the slant left polarization receive signal and the slant right polarization receive signal and outputting a receive signal having a left-hand circular polarization state to one of the antenna ports and for accepting the slant left polarization receive signal and the slant right polarization receive signal and outputting a receive signal having a right-hand circular polarization state to another one of the antenna ports.

13. The antenna system of claim 6, wherein the electric plane of each dipole pair is ±45 degrees with respect to a vertical axis of the antenna system.

14. The antenna system of claim 6, wherein the polarization states of the crossed dipole pair are a slant left polarization and a slant right polarization.

15. The antenna system of claim 6, wherein the radiation patterns comprise a first radiation pattern in an elevation plane of the antenna system and a second radiation pattern in an azimuth plane of the antenna system, the first radiation pattern defined by geometry of the antenna system and the second radiation pattern defined by the characteristics of the dual polarized radiators and the ground plane.

16. The antenna system of claim 6, wherein said ground plane is a substantially planar sheet comprising a conductive material.

17. The antenna system of claim 6, wherein said ground plane is a substantially non-level sheet comprising a conductive material.

18. The antenna system of claim 1, wherein said dual polarized radiators generate the rotationally symmetric radiation patterns in response to a fixed linearly polarized electromagnetic signal having any orientation within 45 degrees of a co-polarized orientation on boresight of the antenna system.

19. The antenna system of claim 1 further comprising a central polarization control network, connected between the distribution network and at least one antenna port, responsive to a first signal having a first polarization state from selected ones of the dual polarized radiators for outputting a second signal having a second polarization state to one of the antenna ports, wherein the first polarization state is different from the second polarization state.

20. The antenna system of claim 19 wherein the central polarization control network is further responsive to a third signal having a third polarization state from the remaining ones of the dual polarized radiators for outputting a fourth signal having a fourth polarization state to another one of the antenna ports, wherein the first polarization state is different from the third polarization state, and the third polarization state is different from the fourth polarization state.

21. An antenna system for transmitting and receiving electromagnetic signals having polarization diversity, comprising:

a plurality of dual polarized radiators, exhibiting dual simultaneous polarization states, for generating substantially rotationally symmetric radiation patterns defined by a co-polarized pattern response having pseudo-circular symmetry properties and E- and H-plane patterns that are different by no more than approximately 3.1 dB at any value of theta over the field of view for the antenna system;

a distribution network, connected to each of the dual polarized radiators, for communicating the electromagnetic signals from and to each of the dual polarized radiators;

a ground plane and spaced apart from the dual polarized radiators by a predetermined distance; and a polarization control network, connected between the distribution network and at least one antenna port, for controlling polarization states of the electromagnetic signals distributed by the distribution network.

22. The antenna system of claim 21, wherein the polarization control network comprises a first duplexer, connected to the first power divider and having a first receive port and a first transmit port, and a second duplexer, connected to the second power divider and having a second receive port and a second transmit port, the first receive port outputting a receive signal having a slant left polarization state to one of the antenna ports and the second receive port outputting a receive signal having a slant right polarization state to another one of the antenna ports, the first and second transmit ports connected to a power combiner for accepting a transmit signal having a vertical polarization state.

23. The antenna system of claim 22 wherein the polarization control network further comprises a 0 degree/180 degree hybrid coupler, connected to the first receive port and the second receive port and to a pair of the antenna ports, for (1) accepting the slant left polarization receive signal and the slant right polarization receive signal and outputting a receive signal having a vertical linear polarization state and (2) accepting the slant left polarization receive signal and the slant right polarization receive signal and outputting a receive signal having a horizontal linear polarization state.

24. The antenna system of claim 22 wherein the polarization control network further comprises a 0 degree/90 degree hybrid coupler, connected to the first receive port and the second receive port and to a pair of the antenna ports, for (1) accepting the slant left polarization receive signal and the slant right polarization receive signal and outputting a receive signal having a left-hand circular polarization state to one of the antenna ports and (2) accepting the slant left polarization receive signal and the slant right polarization receive signal and outputting a receive signal having a right-hand circular polarization state to another one of the antenna ports.

25. The antenna system of claim 21, wherein each of the dual polarized radiators comprises a crossed dipole pair having a first dipole element and a second dipole element positioned orthogonal to each other, the polarization states of the crossed dipole pair maintained for a wide coverage area (half power beamwidth) of at least 45 degrees in an azimuth plane of the antenna system.

26. An antenna system for transmitting and receiving electromagnetic signals having polarization diversity, comprising:

a plurality of dual polarized radiators characterized by dual simultaneous polarization states and having substantially rotationally symmetric radiation patterns; and a distribution network, connected to each of the dual polarized radiators, for communicating the electromagnetic signals from and to each of the dual polarized radiators; and a ground plane, positioned generally parallel to and spaced apart from the dual polarized radiators by a predetermined distance, said ground plane comprising a solid conductive surface having a transverse extent dimension sufficient to achieve the desired polarization state for a vertical polarization component and a non-solid conductive surface comprising an array of parallel, spaced-apart conductive elements aligned within the horizontal plane of the antenna system and symmetrically positioned along each transverse extent of the solid conductive surface, the conductive elements having a transverse extent dimension sufficient to achieve the desired polarization state for a horizontal component.

27. The antenna system of claim 26, wherein said transverse extent dimension of said solid conductive surface is approximately one wavelength for a selected center frequency, and each of the conductive elements of the non-solid conductive surface has a center spacing of approximately ⅓ to ½ of a wavelength for the selected center frequency.

28. The antenna system of claim 26 further comprising a central polarization control network, connected between the distribution network and an antenna port, for controlling the polarization states exhibited by the dual-polarized radiators.

29. The antenna system of claim 28, wherein the distribution network comprises a first power divider connected to each first dipole element and a second power divider connected to each second dipole element, and the polarization control network comprises a first duplexer, connected to the first power divider and having a first receive port and a first transmit port, and a second duplexer, connected to the second power divider and having a second receive port and a second transmit port, the first receive port outputting a receive signal having a slant left polarization state and the second receive port outputting a receive signal having a slant right polarization state, the first and second transmit ports connected to a power combiner for accepting a transmit signal having a vertical polarization state.

30. The antenna system of claim 29 further comprising a 0 degree/180 degree hybrid coupler, connected to the first receive port and the second receive port, for accepting the slant left polarization receive signal and the slant right polarization receive signal and outputting a receive signal having a vertical linear polarization state and for accepting the slant left polarization receive signal and the slant right polarization receive signal and outputting a receive signal having a horizontal linear polarization state.

31. The antenna system of claim 29 further comprising a 0 degree/90 degree hybrid coupler, connected to the first receive port and the second receive port, for accepting the slant left polarization receive signal and the slant right polarization receive signal and outputting a receive signal having a left-hand circular polarization state and for accepting the slant left polarization receive signal and the slant right polarization receive signal and outputting a receive signal having a right-hand circular polarization state.

32. An antenna system for transmitting and receiving electromagnetic signals having polarization diversity, comprising:

a plurality of dual polarized radiators characterized by dual simultaneous polarization states and having substantially rotationally symmetric radiation patterns;

a distribution network, connected to each of the dual polarized radiators, for communicating the electromagnetic signals from and to each of the dual polarized radiators;

a polarization control network, connected between the distribution network and at least one antenna port, for controlling polarization states of the electromagnetic signals distributed by the distribution network; and a ground plane, spaced apart from the dual polarized radiators by a predetermined distance, comprising a solid conductive surface having a transverse extent dimension sufficient to achieve the desired polarization state for a vertical polarization component and a non-solid conductive surface comprising an array of parallel, spaced-apart conductive elements aligned within the horizontal plane of the antenna system and symmetrically positioned along each transverse extent of the solid conductive surface.

33. The antenna system of claim 32, wherein said ground plane is a substantially level sheet comprising a conductive material.

34. The antenna system of claim 32, wherein said ground plane is a substantially non-level sheet comprising a conductive material.

35. The antenna system of claim 32, wherein the polarization control network comprises a first duplexer, connected to the first power divider and having a first receive port and a first transmit port, and a second duplexer, connected to the second power divider and having a second receive port and a second transmit port, the first receive port outputting a receive signal having a slant left polarization state and the second receive port outputting a receive signal having a slant right polarization state, the first and second transmit ports connected to a power combiner for accepting a transmit signal having a vertical polarization state.

36. The antenna system of claim 35 further comprising a 0 degree/180 degree hybrid coupler, connected to the first receive port and the second receive port, for (1) accepting the slant left polarization receive signal and the slant right polarization receive signal and outputting a receive signal having a vertical linear polarization state and (2) accepting the slant left polarization receive signal and the slant right polarization receive signal and outputting a receive signal having a horizontal linear polarization state.

37. The antenna system of claim 35 further comprising a 0 degree/90 degree hybrid coupler, connected to the first receive port and the second receive port, for (1) accepting the slant left polarization receive signal and the slant right polarization receive signal and outputting a receive signal having a left-hand circular polarization state and (2) accepting the slant left polarization receive signal and the slant right polarization receive signal and outputting a receive signal having a right-hand circular polarization state.

38. An antenna system for transmitting and receiving electromagnetic signals having polarization diversity, comprising:

a plurality of dual polarized radiators characterized by dual simultaneous polarization states and having substantially rotationally symmetric radiation patterns, each of the dual polarized radiators comprising a crossed dipole pair having a first dipole element and a second dipole element positioned orthogonal to each other, the polarization states of the crossed dipole pair maintained for a wide coverage area (half power beamwidth) of at least 45 degrees in an azimuth plane of the antenna system;

a distribution network, connected to each of the dual polarized radiators, for communicating the electromagnetic signals from and to each of the dual polarized radiators;

a polarization control network, connected between the distribution network and at least one antenna port, for controlling polarization states of the electromagnetic signals distributed by the distribution network; and a ground plane, spaced apart from the dual polarized radiators by a predetermined distance, comprising a solid conductive surface having a transverse extent dimension sufficient to achieve the desired polarization state for a vertical polarization component and a non-solid conductive surface comprising an array of parallel, spaced-apart conductive elements aligned within the horizontal plane of the antenna system and symmetrically positioned along each transverse extent of the solid conductive surface.

39. The antenna system of claim 38, wherein said ground plane is a substantially level sheet comprising a conductive material.

40. The antenna system of claim 38, wherein said ground plane is a substantially non-level sheet comprising a conductive material.

41. An antenna system for transmitting and receiving electromagnetic signals having polarization diversity, comprising:

a plurality of dual polarized radiators, exhibiting dual simultaneous polarization states, for generating substantially rotationally symmetric radiation patterns defined by a co-polarized pattern response having pseudo-circular symmetry properties;

a distribution network, connected to each of the dual polarized radiators, for communicating the electromagnetic signals from and to each of the dual polarized radiators;

a ground plane and spaced apart from the dual polarized radiators by a predetermined distance; and a polarization control network, connected between the distribution network and at least one antenna port, for controlling polarization states of the electromagnetic signals distributed by the distribution network, wherein the beamwidth of the antenna system in the azimuth plane is at least twice greater than or equal to the beamwidth of the antenna system in the elevation plane.

42. The antenna system of claim 41, wherein the dual polarized radiators comprise non-planar conductive elements.

43. An antenna system for transmitting and receiving electromagnetic signals having polarization diversity, comprising:

a plurality of dual polarized radiators, comprising non-planar conductive elements and exhibiting dual simultaneous polarization states, for generating substantially rotationally symmetric radiation patterns defined by a co-polarized pattern response having pseudo-circular symmetry properties;

a distribution network, connected to each of the dual polarized radiators, for communicating the electromagnetic signals from and to each of the dual polarized radiators;

a ground plane and spaced apart from the dual polarized radiators by a predetermined distance; and a polarization control network, connected between the distribution network and at least one antenna port, for controlling polarization states of the electromagnetic signals distributed by the distribution network, wherein the number of radiators along the vertical extent of the antenna system are greater than or equal to twice the number of radiators along the horizontal extent of the antenna system.

* * * * *